US011123992B2

(12) United States Patent
Ono et al.

(10) Patent No.: US 11,123,992 B2
(45) Date of Patent: Sep. 21, 2021

(54) SYSTEM INCLUDING FIRST AND SECOND TANKS WITH RESPECTIVE FIRST AND SECOND RESERVOIRS

(71) Applicant: BROTHER KOGYO KABUSHIKI KAISHA, Nagoya (JP)

(72) Inventors: Akihito Ono, Nagoya (JP); Kosuke Nukui, Nagoya (JP); Akinari Ishibe, Okazaki (JP); Hiroaki Takahashi, Nagoya (JP); Takahiro Miyao, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/743,529

(22) Filed: Jan. 15, 2020

(65) Prior Publication Data

US 2020/0230965 A1 Jul. 23, 2020

(30) Foreign Application Priority Data

Jan. 17, 2019 (JP) ..... JP2019-005743

(51) Int. Cl.

| | |
|---|---|
| ***B41J 2/175*** | (2006.01) |
| ***B41J 29/13*** | (2006.01) |
| *B41J 2/21* | (2006.01) |
| *B41J 2/17* | (2006.01) |

(52) U.S. Cl.

CPC ..... *B41J 2/17503* (2013.01); *B41J 2/175* (2013.01); *B41J 2/1752* (2013.01); (Continued)

(58) Field of Classification Search

CPC .... B41J 2/17503; B41J 29/13; B41J 2/17553; B41J 2/175; B41J 2/1752; B41J 2/17509; (Continued)

(56) References Cited

U.S. PATENT DOCUMENTS

2008/0252708 A1* 10/2008 Hakamada ..... B41J 2/17513 347/95
2009/0201351 A1* 8/2009 Shimizu ..... B41J 2/17509 347/87

(Continued)

FOREIGN PATENT DOCUMENTS

JP 2016-196109 A 11/2016
JP 2017-081121 A 5/2017

(Continued)

*Primary Examiner* — Henok D Legesse
(74) *Attorney, Agent, or Firm* — Merchant & Gould P.C.

(57) ABSTRACT

A system includes:

a casing that has a conveyance path and through which a sheet passes;

a first tank that is disposed on one side of the conveyance path;

a second tank that is disposed on the other side of the conveyance path;

a first reservoir that is connectable to the first tank;

a second reservoir that is connectable to the second tank; and a liquid ejection head that is disposed inside the casing and is configured to eject liquid supplied from the first tank and the second tank, wherein the first reservoir includes a first liquid flowing hole, the second reservoir includes a second liquid flowing hole, the first tank includes a first flow conduit connectable to the first liquid flowing hole, and the second tank includes a second flow conduit connectable to the second liquid flowing hole.

10 Claims, 14 Drawing Sheets

(52) U.S. Cl.
CPC ..... *B41J 2/17509* (2013.01); *B41J 2/17553* (2013.01); *B41J 29/13* (2013.01); *B41J 2/17* (2013.01); *B41J 2/1753* (2013.01); *B41J 2/17513* (2013.01); *B41J 2/17546* (2013.01); *B41J 2/17566* (2013.01); *B41J 2/21* (2013.01)

(58) Field of Classification Search
CPC .. B41J 2/17546; B41J 2/17566; B41J 2/1753; B41J 2/17513; B41J 2/17523
See application file for complete search history.

(56) References Cited

U.S. PATENT DOCUMENTS

| | | | | |
|---|---|---|---|---|
| 2011/0074842 | A1* | 3/2011 | Hyakudome | B41J 2/17596 347/7 |
| 2013/0187993 | A1* | 7/2013 | Aoki | B41J 2/17503 347/86 |
| 2014/0036006 | A1* | 2/2014 | Tamaki | B41J 2/1752 347/85 |
| 2016/0052290 | A1* | 2/2016 | Takahashi | B41J 2/17596 347/7 |
| 2016/0288519 | A1 | 10/2016 | Danzuka et al. | |
| 2017/0120617 | A1 | 5/2017 | Matsumura et al. | |
| 2017/0341405 | A1 | 11/2017 | Maruyama | |
| 2018/0215164 | A1 | 8/2018 | Hayashi et al. | |

FOREIGN PATENT DOCUMENTS

| | | | |
|---|---|---|---|
| JP | 2017-209948 | A | 11/2017 |
| JP | 2018-122515 | A | 8/2018 |

* cited by examiner

SYSTEM INCLUDING FIRST AND SECOND TANKS WITH RESPECTIVE FIRST AND SECOND RESERVOIRS

CROSS REFERENCE TO RELATED APPLICATIONS

This application is based on Japanese Patent Applications No. 2019-005743 filed on Jan. 17, 2019, the entire contents of which are incorporated herein by reference.

TECHNICAL FIELD

The present invention relates to a system including a reservoir that stores liquid and a tank to which the reservoir can be connected.

BACKGROUND

Conventionally, a system including a reservoir that stores liquid and a tank to which the reservoir can be connected is known. For example, JP-A-2018-122515 discloses a system configured to include an ink cartridge that stores ink and an image recording apparatus that includes a tank to which the ink cartridge can be connected.

The image recording apparatus disclosed in JP-A-2018-122515 includes a feed tray that supports sheets fed into the apparatus and a discharge tray that supports sheets discharged from the apparatus. The feed tray and the discharge tray are disposed at a central portion in a width direction of the image recording apparatus.

The image recording apparatus disclosed in JP-A-2018-122515 includes four tanks, and an ink cartridge is connected to each tank. When a user operates the image recording apparatus (for example, when the user operates a touch panel of the image recording apparatus or sets a sheet in the image recording apparatus) all the four tanks are disposed on the right side of the feed tray and the discharge tray when viewed from the user.

However, in the image recording apparatus disclosed in JP-A-2018-122515, when the user operates the image recording apparatus, the tanks are disposed on the right side of the feed tray and the discharge tray, while the tanks are not disposed on the left side of the feed tray and the discharge tray when viewed from the user. Therefore, in the image recording apparatus disclosed in JP-A-2018-122515, a space on the left side of the feed tray and the discharge tray cannot be effectively utilized. For that reason, enlargement of a tank size has been limited.

The present invention has been made in view of the circumstances described above, and an object thereof is to provide a system capable of enlarging a tank.

SUMMARY (1) According to an aspect of the invention, a system includes:

a casing that has a conveyance path that extends in a depth direction of the casing intersecting a height direction of the casing and through which a sheet passes;

a first tank that is disposed on one side of the conveyance path and in the casing in a width direction of the casing orthogonal to the height direction and the depth direction and is configured to store liquid in the first tank;

a second tank that is disposed on the other side of the conveyance path and in the casing in the width direction and is configured to store liquid in the second tank;

a first reservoir that is connectable to the first tank and is configured to store liquid in the first reservoir;

a second reservoir that is connectable to the second tank and is configured to store liquid in the second reservoir; and a liquid ejection head that is disposed inside the casing and is configured to eject liquid supplied from the first tank and the second tank, wherein the first reservoir includes a first liquid flowing hole through which the liquid stored in the first reservoir is flowable to the outside of the reservoir, the second reservoir includes a second liquid flowing hole through which the liquid stored in the second reservoir flows to the outside of the second reservoir, the first tank includes a first flow conduit connectable to the first liquid flowing hole along a first direction intersecting the height direction and the width direction, and the second tank includes a second flow conduit connectable to the second liquid flowing hole along the first direction.

DETAILED DESCRIPTION OF PREFERRED EMBODIMENTS

Hereinafter, illustrative aspects of the present invention will be described with reference to the accompanying drawings as appropriate. The illustrative aspects described below is merely an example in which the present invention is embodied, and it is needless to say that the illustrative aspects can be appropriately changed without departing from the gist of the present invention.

Overall configuration of a multi function device 10

Figure 1:
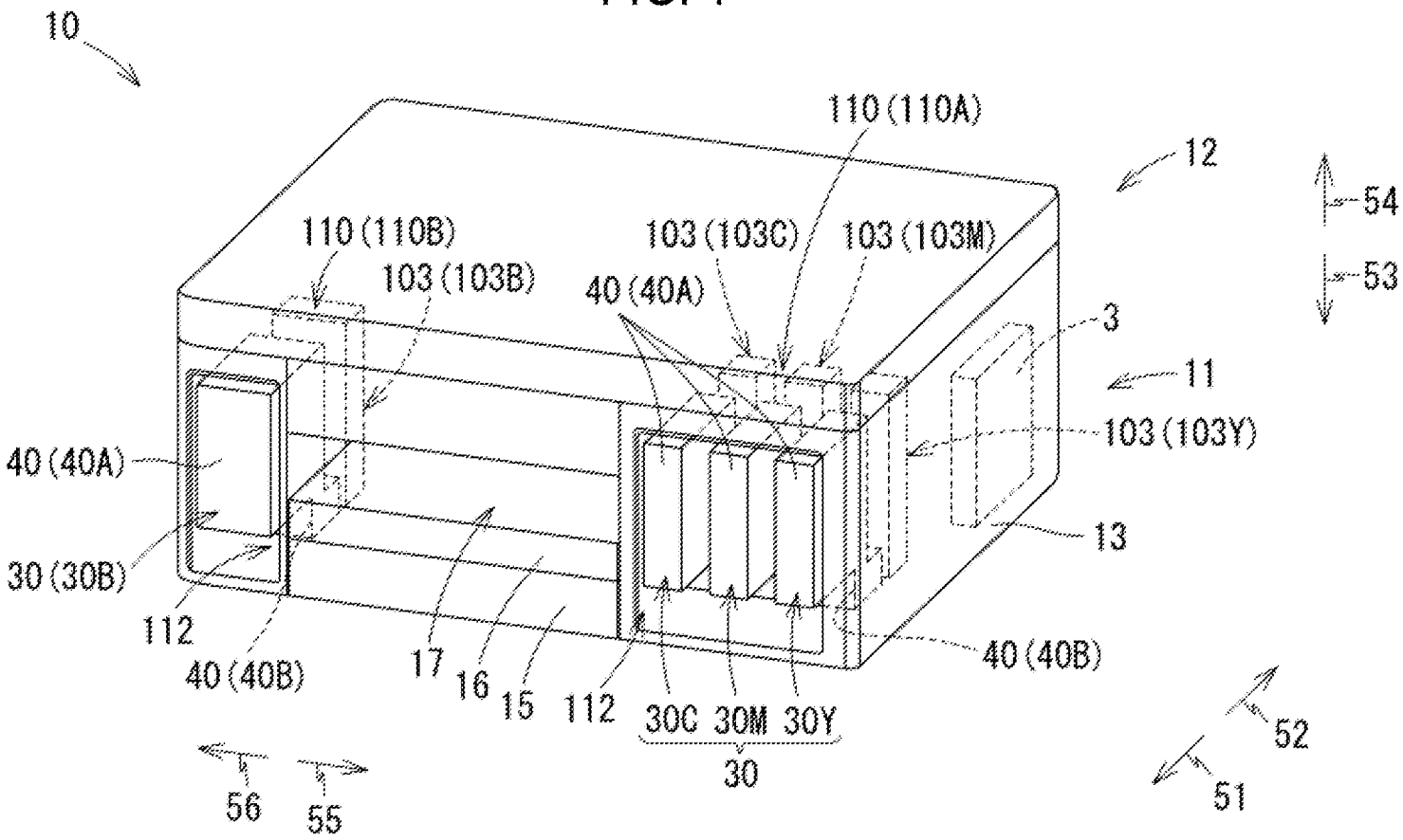
FIG. 1 is a perspective view of a multi function device 10 to which an ink cartridge 30 is mounted.
Figure 2:
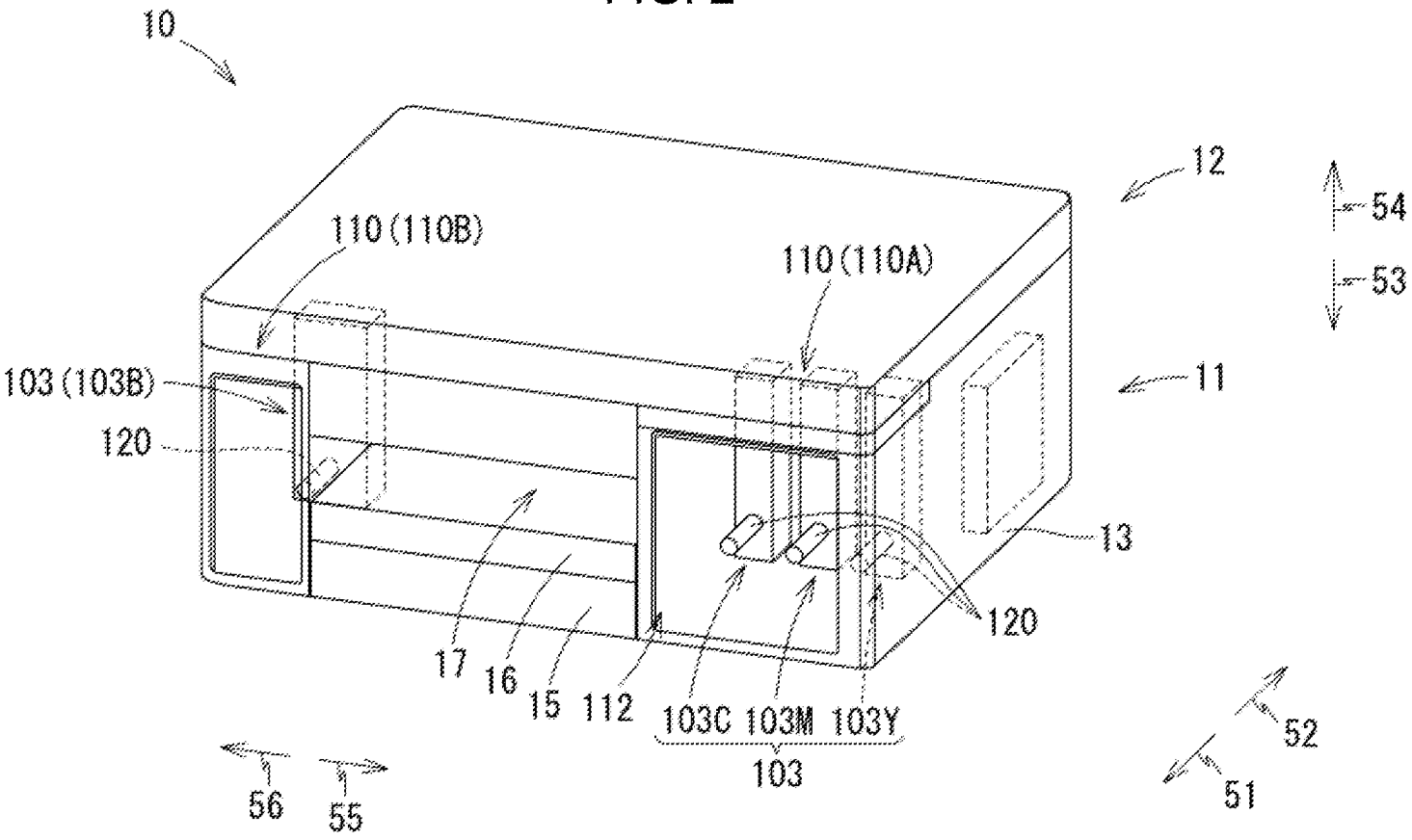
FIG. 2 is a perspective view of the multi function device 10 to which the ink cartridge 30 is not mounted.

As illustrated in FIGS. 1 and 2, a multi function device 10 has a generally rectangular parallelepiped shape as a whole.

The gravity direction is defined as a downward direction 53 and the opposite direction to the downward direction 53 is defined as an upward direction 54, based on a posture at which the multi function device 10 is installed on a horizontal plane to be usable. A forward direction 51 and a rearward direction 52 opposite to the forward direction 51 are defined with a front wall 44 being a wall where an opening 17 of the multi function device 10 is provided. A rightward direction 55 and a leftward direction 56 are defined when the multi function device 10 is viewed from the front. The upward direction 54 and the downward direction 53, the forward direction 51 and the rearward direction 52, and the rightward direction 55 and the leftward direction 56 are orthogonal to each other. The forward direction 51 and the rearward direction 52 are defined as a front-rear direction (an example of the depth direction). The upward direction 54 and the downward direction 53 are defined as an up-down direction (an example of a height direction). The rightward direction 55 and the leftward direction 56 are defined as a left-right direction (an example of the width direction).

The multi function device 10 includes a printer 11 and a scanner 12. The multi function device 10 and an ink cartridge 30 described later constitute a system.

The printer 11 is an image recording apparatus that records an image by ejecting ink droplets onto a sheet 2 (an example of a sheet, see FIG. 3) based on an inkjet recording method, and is, for example, an inkjet printer. The printer 11 includes a casing 13. The scanner 12 is a known flatbed scanner. For that reason, detailed description of the scanner 12 is omitted.

Figure 3:
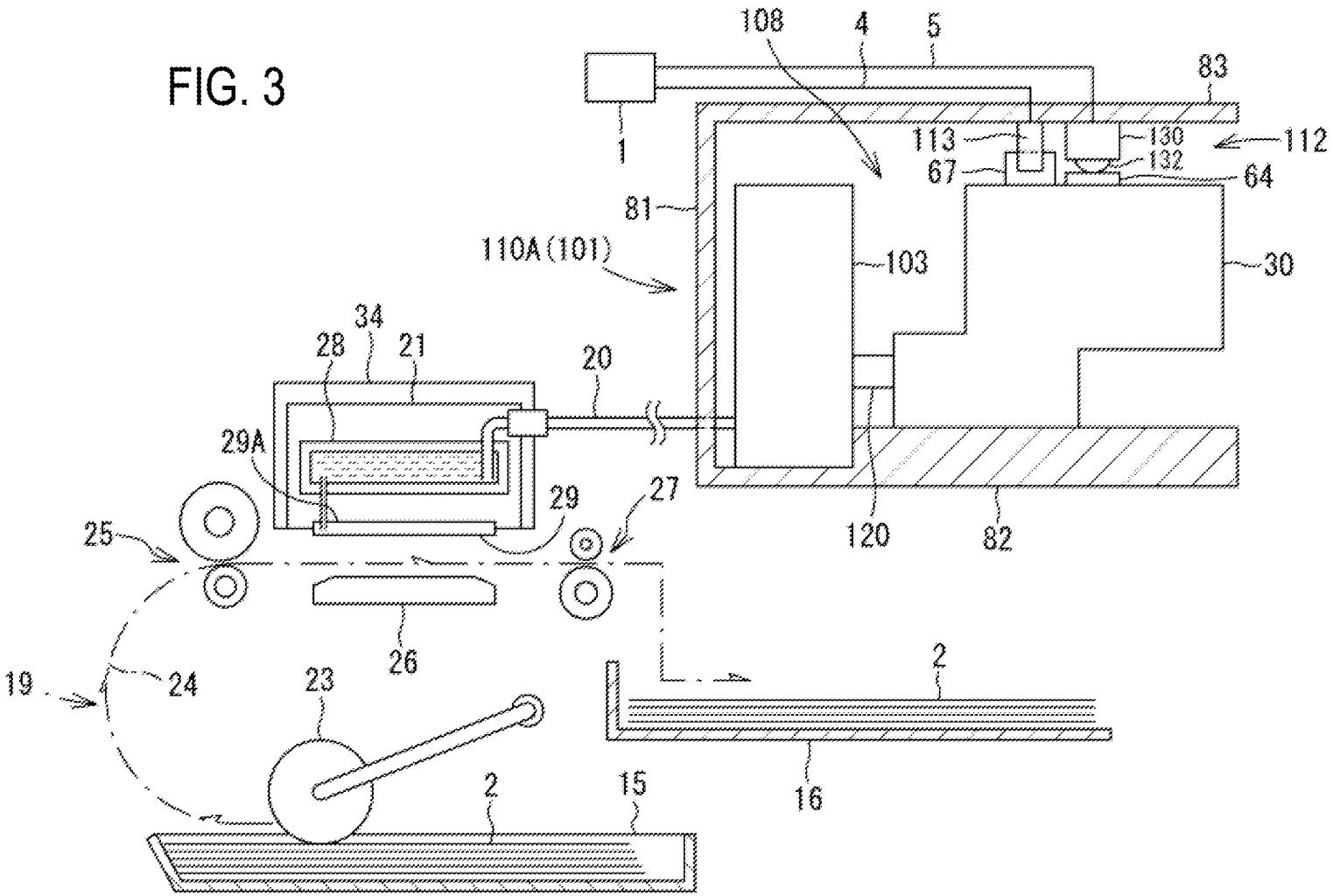
FIG. 3 is a longitudinal sectional view schematically illustrating an internal structure of the multi function device 10.

As illustrated in FIG. 3, the multi function device 10 includes a recording head 21 (an example of a liquid ejection head), a mounting unit 110, and an ink tube 20. At least one tank 103 capable of storing ink is disposed in the mounting unit 110. The ink cartridge 30 is mounted to the mounting unit 110. The ink cartridge 30 stores ink (an example of liquid) supplied to a recording head 21. The ink cartridge 30 mounted to the mounting unit 110 is connected to the tank 103. The ink tube 20 connects the recording head 21 and at least one tank 103. An opening 112 is formed at the front end of the mounting unit 110.

Figure 8:
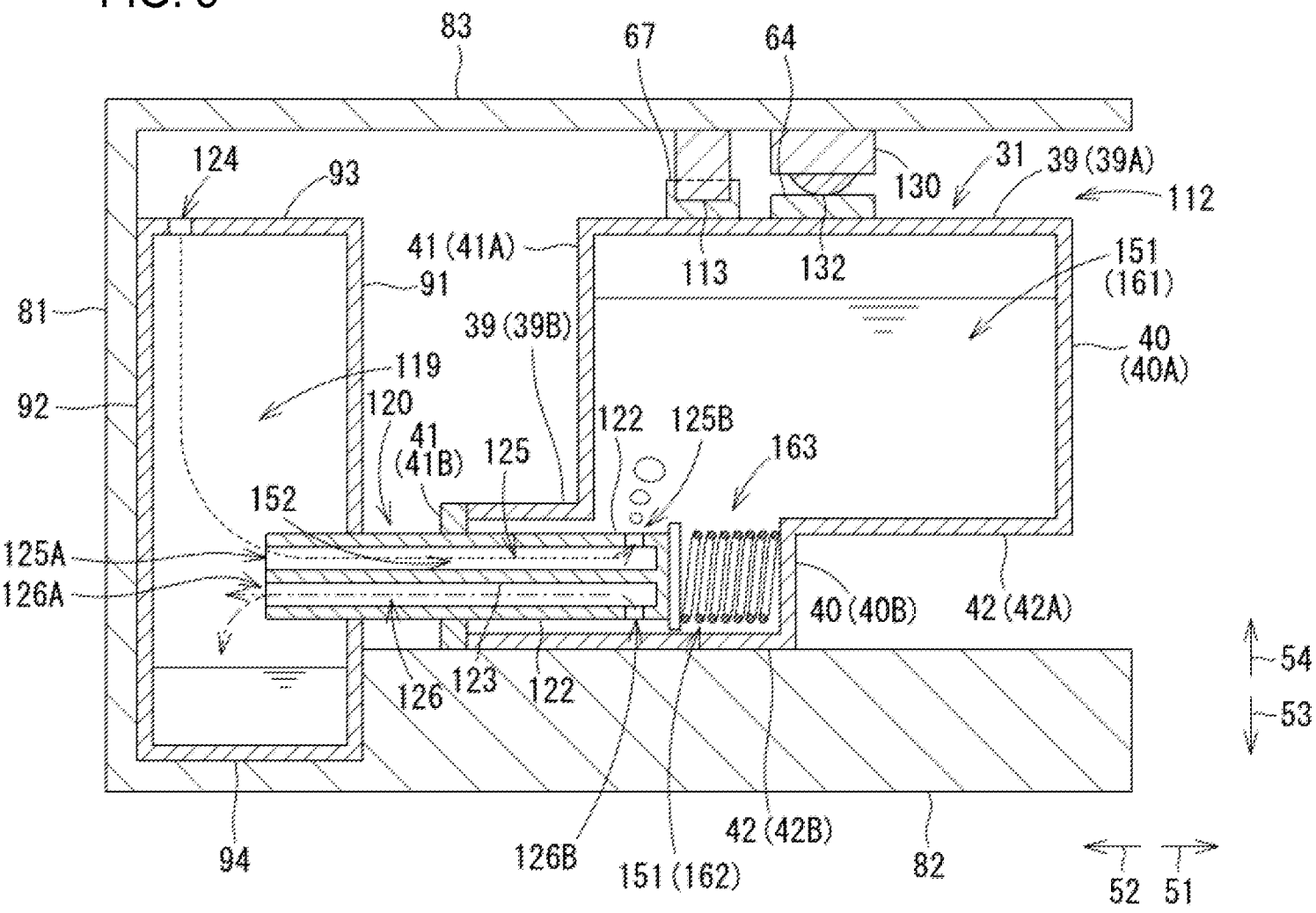
FIG. 8 is a longitudinal sectional view of the periphery of the ink cartridge 30 in a mounted state.

The ink cartridge 30 is inserted and mounted to the mounting unit 110 from the front to the rear through the opening 112. The ink cartridge 30 is extracted from the mounting unit 110 from the rear to the front through the opening 112. That is, the ink cartridge 30 can be inserted into and extracted from the mounting unit 110 along the front-rear direction (an example of a first direction). FIGS. 1, 3, and 8 illustrate a mounted state in which mounting of the ink cartridge 30 to the mounting unit 110 is completed. FIG. 2 illustrates a state where the ink cartridge 30 is not mounted to the mounting unit 110.

As illustrated in FIG. 3, the ink cartridge 30 and the recording head 21 are connected via the tank 103 and the ink tube 20 in the mounted state. The recording head 21 is disposed inside the casing 13. The recording head 21 includes a sub tank 28. The sub tank 28 temporarily stores ink supplied through the ink tube 20. The recording head 21 ejects the ink supplied from the sub tank 28 from nozzles 29 by an ink jet recording method. Specifically, a drive voltage is selectively applied from a head control board (not illustrated) provided on the recording head 21 to piezoelectric elements 29A provided corresponding to the nozzles 29. With this configuration, ink is ejected from the nozzles 29. The recording head 21 is equipped on a carriage 34. The carriage 34 is supported by a frame (not illustrated) of the casing 13 to be movable along the left-right direction.

The multi function device 10 includes a feed tray 15, a feed roller 23, a conveyance roller pair 25, a platen 26, a discharge roller pair 27, and a discharge tray 16. The sheet 2 fed from the feed tray 15 to a conveyance path 24 by the feed roller 23 is conveyed in a conveyance direction 19 by the conveyance roller pair 25. The conveyance direction 19 is indicated by a one-dot chain line arrow in FIG. 3. When the sheet 2 is conveyed to a platen 26 by the conveyance roller pair 25, the carriage 34 moves along the left-right direction. In this case, the recording head 21 ejects ink onto the sheet that passes over the platen 26. With this configuration, an image is recorded on the sheet 2. The sheet 2 that has passed through the platen 26 is supported by the discharge roller pair 27 on the discharge tray 16 provided on the most downstream side of the conveyance path 24. The sheet 2 supported on the discharge tray 16 is discharged through the opening 17.

Figure 4:
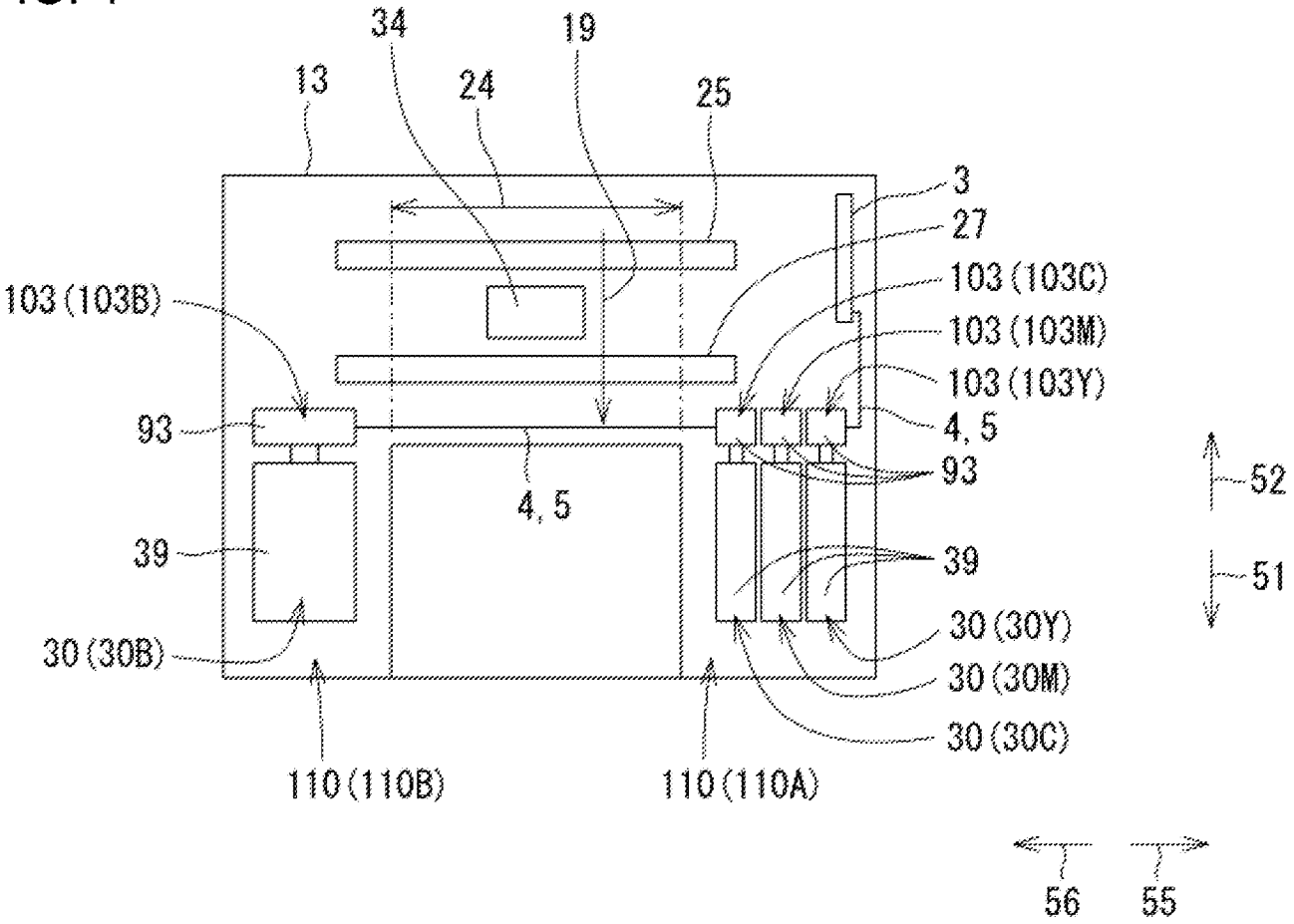
FIG. 4 is a plan view of a casing 13.

As illustrated in FIG. 4, the conveyance path 24 extends in the front-rear direction from the conveyance roller pair 25 to the discharge roller pair 27 by passing through a space between the recording head 21 and the platen 26. The conveyance path 24 is formed in the central portion of the casing 13 in the substantially left-right direction. The carriage 34 is movable to an area where the conveyance path 24 is formed (an area between two one-dot chain lines in FIG. 4), an area to the right side of the conveyance path 24, and an area to the left side of the conveyance path 24.

Mounting unit 110

As illustrated in FIGS. 1 and 2, the mounting unit 110 includes a mounting unit 110A disposed at the right end part of the casing 13 and a mounting unit 110B disposed at the left end part of the casing 13. As illustrated in FIG. 4, the mounting unit 110A is on the right side of the conveyance path 24. The mounting unit 110B is on the left side of the conveyance path 24. The mounting unit 110A and the mounting unit 110B have substantially the same configuration. For that reason, in the following, the configuration of the mounting unit 110A will be described, and the configuration of the mounting unit 110B will be omitted in principle and will be described as necessary.

As illustrated in FIG. 3, the mounting unit 110A includes a holder 101, the tank 103, an optical sensor 113, and a connector 130. The mounting unit 110A may not include the optical sensor 113.

Holder 101

As illustrated in FIG. 3, the holder 101 constitutes a casing of the mounting unit 110A. The holder 101 includes a back wall 81, a bottom wall 82, and a top wall 83. The bottom wall 82 extends forward from the lower end part of the back wall 81. The top wall 83 is spaced from the bottom wall 82 in the up-down direction, and extends forward from the upper end portion of the back wall 81. An internal space 108 of the holder 101 is formed by the back wall 81, the bottom wall 82, and the top wall 83. The front end of the holder 101 facing the back wall 81 in the front-rear direction is the opening 112 connected to the internal space 108. The opening 112 faces the user when the user uses the multi-function device 10.

As illustrated in FIGS. 1 and 3, the ink cartridge 30 can be connected to the tank 103.

The internal space 108 of the holder 101 is partitioned into three rooms aligned in the left-right direction by a partition wall (not illustrated). The tank 103, the optical sensor 113, and the connector 130 may be disposed in each room of the partitioned internal space 108. The internal space 108 may not include a partition wall. Here, all the tanks 103, optical sensors 113, and connectors 130 to be disposed are disposed in the internal space 108 that is one room.

In the illustrative aspect, one ink cartridge 30 is mounted on the mounting unit 110B. For that reason, the internal space 108 of the holder 101 of the mounting unit 110B is not partitioned into a plurality of rooms (is constituted with one room).

In the illustrative aspect, the tank 103 and the optical sensor 113 are disposed in each of the three rooms of the mounting unit 110A, and the connector 130 is not disposed. On the other hand, the tank 103, the optical sensor 113, and the connector 130 are disposed in one room of the mounting unit 110B.

The number of rooms in the internal space 108 of the holders 101 of the mounting units 110A and 110B, and the number of tanks 103, optical sensors 113, and connectors 130 disposed in each of the rooms are not limited to the numbers described above.

Tank 103

As illustrated in FIG. 3, the tank 103 is provided in the rear part of the internal space 108 of the holder 101. The tank 103 is supported by the bottom wall 82.

Figure 5A:
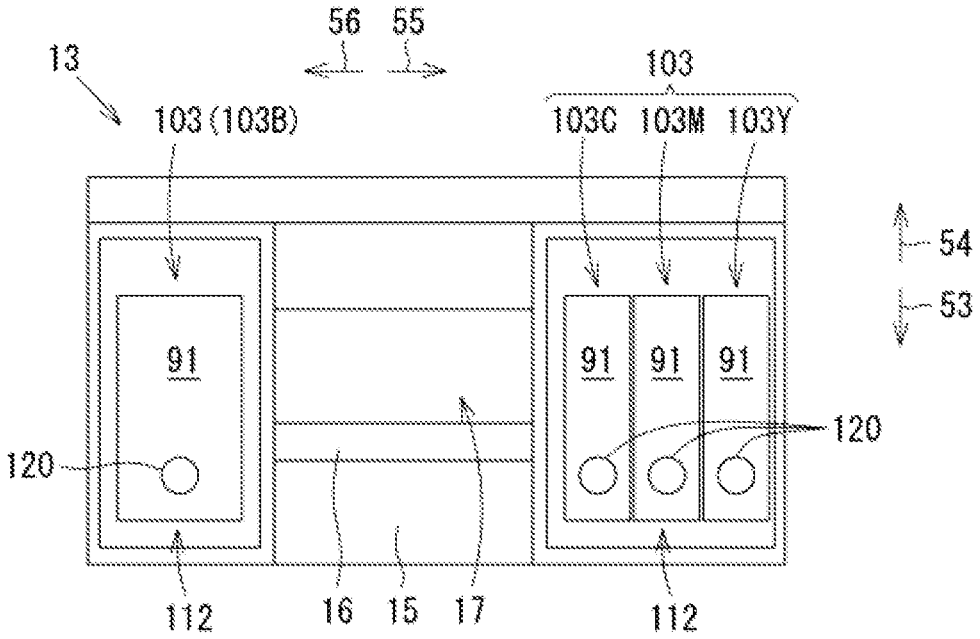
FIGS. 5A and 5B are front views of the casing 13.
Figure 5B:
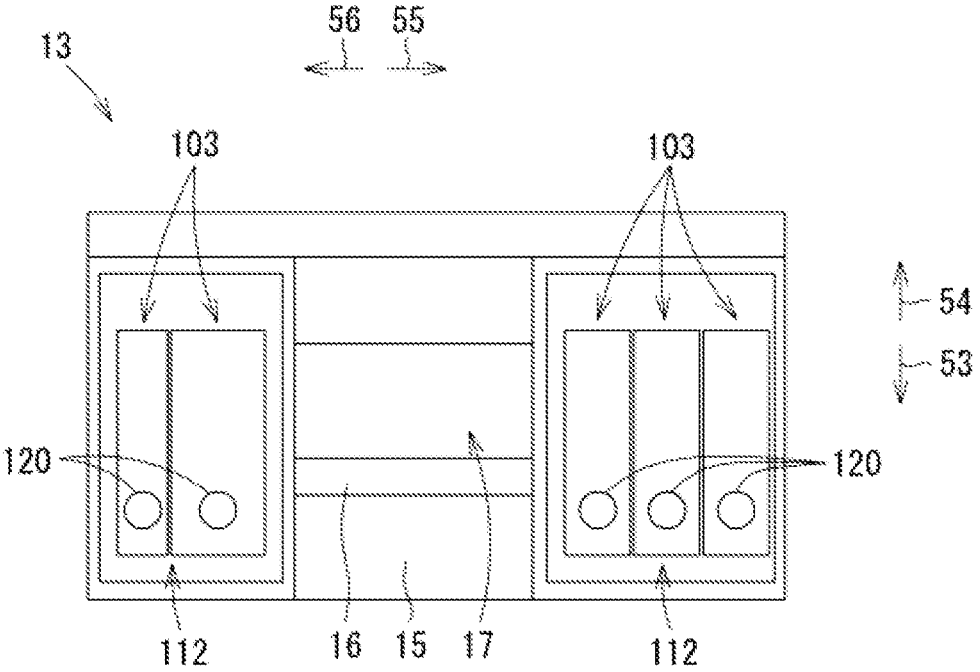

As described above, the internal space 108 of the holder 101 of the mounting unit 110A is partitioned into three rooms aligned in the left-right direction. That is, as illustrated in FIG. 5A, in the internal space 108 of the holder 101 of the mounting unit 110A, three tanks 103 are disposed in parallel along the left-right direction. As illustrated in FIG. 5B, when a plurality of tanks 103 are disposed in the mounting unit 110B, the plurality of tanks 103 may also be disposed in parallel along the left-right direction.

Figure 6B:
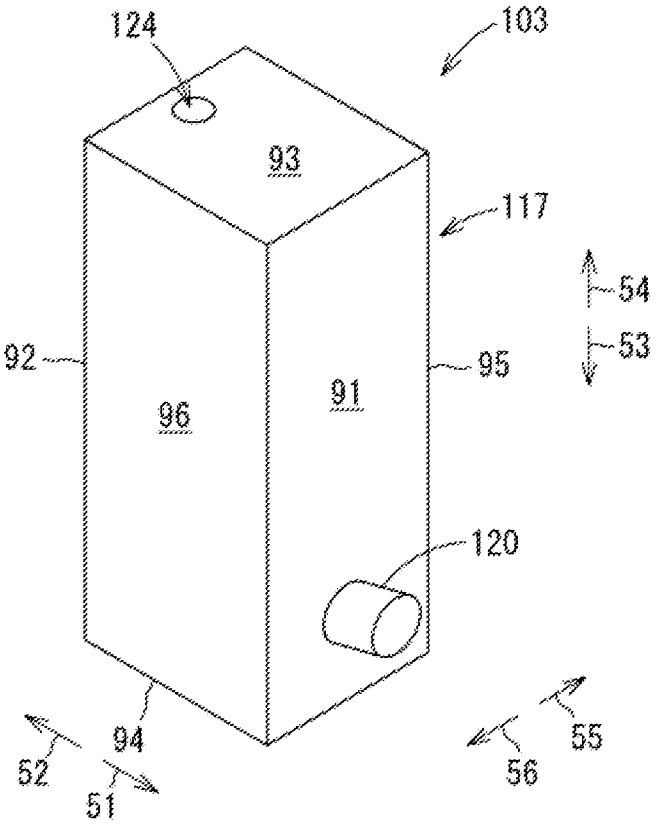
FIG. 6B is a perspective view of a tank 103.

As illustrated in FIG. 6B, the tank 103 includes a casing 117 having a substantially rectangular parallelepiped shape.

The casing 117 includes a front wall 91, a rear wall 92, an upper wall 93, a lower wall 94, a right side wall 95, and a left side wall 96. The front wall 91 and the rear wall 92 are separated in the front-rear direction. The upper wall 93 is between the front wall 91 and the rear wall 92, and extends from the upper end of the front wall 91 to the upper end of the rear wall 92. The lower wall 94 is between the front wall 91 and the rear wall 92, and extends from the lower end of the front wall 91 to the lower end of the rear wall 92. The upper wall 93 and the lower wall 94 connect the front wall 91 and the rear wall 92. The right side wall 95 is between the front wall 91 and the rear wall 92 and extends from the right end of the front wall 91 to the right end of the rear wall 92. The left side wall 96 is between the front wall 91 and the rear wall 92, and extends from the left end of the front wall 91 to the left end of the rear wall 92. The right side wall 95 and the left side wall 96 connect the front wall 91 and the rear wall 92. The upper wall 93 and the lower wall 94 are separated in the up-down direction. The right side wall 95 and the left side wall 96 are separated in the left-right direction. The peripheral edges of the right side wall 95 and the left side wall 96 are continuous with the front wall 91, the rear wall 92, the upper wall 93, and the lower wall 94.

Figure 7:
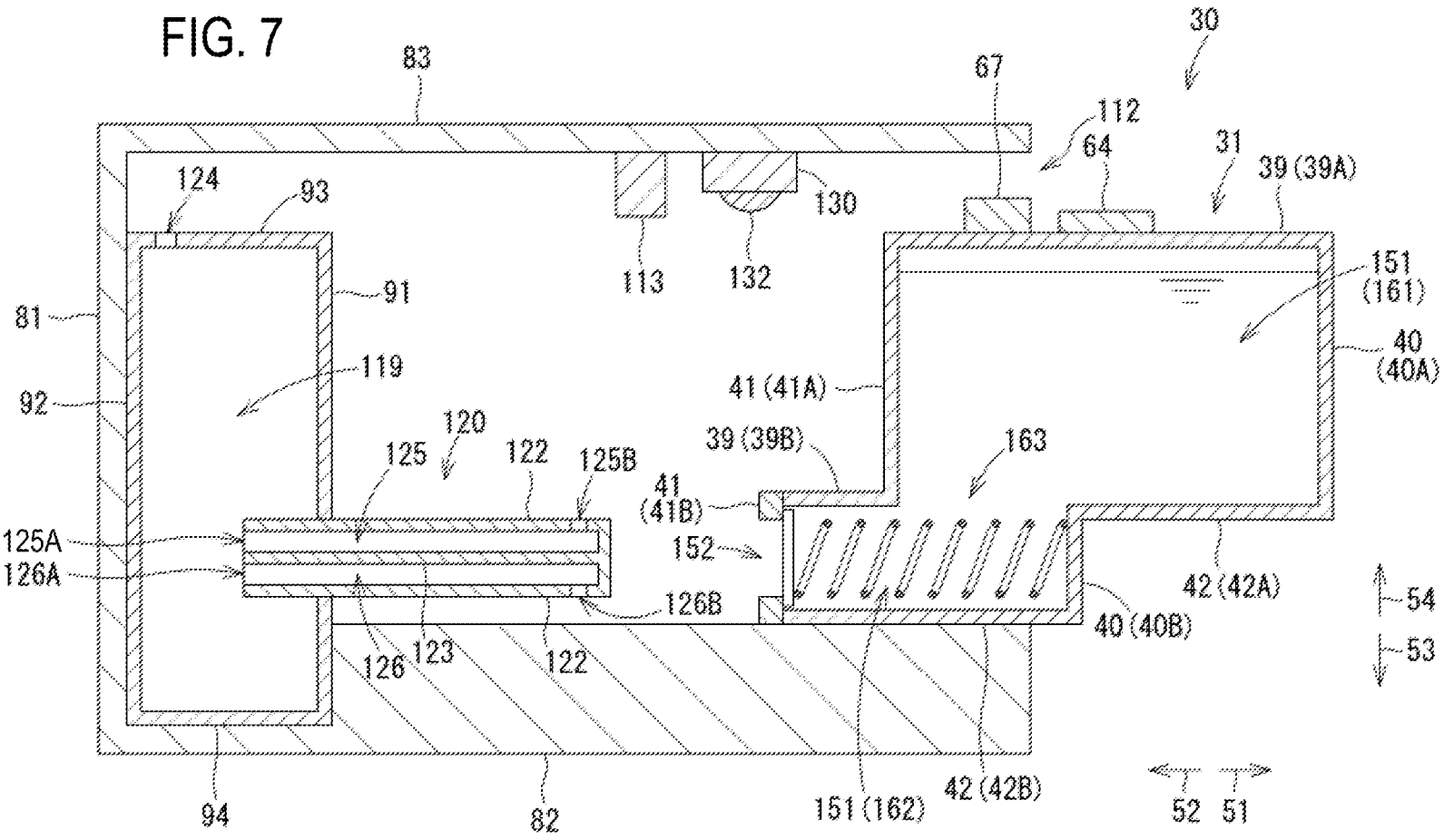
FIG. 7 is a longitudinal sectional view of the ink cartridge 30 in a state of not being mounted and a periphery thereof.

As illustrated in FIG. 7, the casing 117 has an internal space 119. The internal space 119 is a space constituted with the front wall 91, the rear wall 92, the upper wall 93, the lower wall 94, the right side wall 95, and the left side wall 96. Ink can be stored in the internal space 119.

In the illustrative aspect, as illustrated in FIG. 2, in three rooms of the internal space 108 of the holder 101 of the mounting unit 110A, a tank 103 (hereinafter referred to as tank 103C) in which cyan ink is stored, a tank 103 (hereinafter referred to as a tank 103M) in which magenta ink is stored, and a tank 103 (hereinafter referred to as a tank 103Y) in which yellow ink is stored are disposed in order from the left room. In one room of the internal space 108 of the holder 101 of the mounting unit 110B, a tank 103 (hereinafter referred to as a tank 103B) in which black ink is stored is disposed. Hereinafter, the tanks 103C, 103M, 103Y, and 103B are collectively referred to as the tank 103. In the illustrative aspect, dye ink is stored in all the tanks 103. The tank 103B is an example of a first tank. The tanks 103C, 103M, and 103Y are examples of a second tank.

Color of ink stored in each tank 103 is not limited to the color described above. A material of the ink stored in each tank 103 is not limited to dye. For example, in the tank 103 disposed in one room of the internal space 108 of the holder 101 of the mounting unit 110B, ink having a specific gravity (second specific gravity) larger than the specific gravity (first specific gravity) of the ink stored in the tanks 103 disposed in the three spaces of the internal space 108 of the holder 101 of the mounting unit 110A may be stored. Examples of the second specific gravity ink include white ink and pigment ink. Examples of the first specific gravity ink include cyan, magenta, and yellow inks and dye ink.

The color and material of the ink stored in the tank 103 disposed in each room is not limited to the example described above and can be set as appropriate.

The casing 117 has translucency that allows the ink stored in the internal space 119 can be visually recognized from the outside.

As illustrated in FIG. 2, the front wall 91 of the casing 117 is directed forward. With this configuration, the front wall 91 is visible through the opening 112 when the casing 13 is viewed from the front. The front wall 91 has translucency. For that reason, when the casing 13 is viewed from the front, the ink stored in the internal space 119 is visible through the opening 112 and the front wall 91. In the illustrative aspect, the ink stored in the tanks 103C, 103M, and 103Y is visible through the opening 112 and the front wall 91 formed at the right end part of the front wall 44, and the ink stored in the tank 103B is visible through the opening 112 and the front wall 91 formed at the left end part of the front wall 44.

In a casing 31 of the tank 103, it is sufficient that at least the front wall 91 directed forward has translucency.

As illustrated in FIG. 6B, an atmosphere communication hole 124 penetrating the upper wall 93 is formed in the upper wall 93 of the casing 117 of the tank 103. With this configuration, the internal space 119 communicates with the atmosphere. The internal space 119 communicates with the ink tube 20. With this configuration, the ink stored in the internal space 119 is supplied to the recording head 21 through the ink tube 20.

As illustrated in FIG. 7, the tank 103 includes a flow conduit 120. The flow conduit 120 provided in the tank 103B is an example of a first flow conduit. The flow conduits 120 provided in the tanks 103C, 103M, and 103Y are examples of a second flow conduit.

The flow conduit 120 extends in the front-rear direction and penetrates the front wall 91. The flow conduit 120 extends forward from the front wall 91.

The flow conduit 120 includes an outer peripheral wall 122 and a partition wall 123. The partition wall 123 divides the internal space of the outer peripheral wall 122 into two spaces. One of the two spaces is a first flow path 125. The other of the two spaces is a second flow path 126.

The first flow path 125 is a space surrounded by the upper part of the outer peripheral wall 122 and the partition wall 123. An opening 125A is formed at one end of the first flow path 125, and an opening 125B is formed at the other end of the first flow path 125. In the illustrative aspect, the opening 125B is formed on the outer peripheral wall 122.

The second flow path 126 is a space surrounded by the lower part of the outer peripheral wall 122 and the partition wall 123. An opening 126A is formed at one end of the second flow path 126, and an opening 126B is formed at the other end of the second flow path 126. In the illustrative aspect, the opening 126B is formed on the outer peripheral wall 122.

The openings 125A and 126A are in the internal space 119. The openings 125A and 126A are below the atmosphere communication hole 124. The opening 126A is below the opening 125A.

The openings 125B and 126B are outside the tank 103. The opening 125B allows the internal space 119 to communicate with the outside of the tank 103 via the first flow path 125. The opening 126B allows the internal space 119 to communicate with the outside of the tank 103 via the second flow path 126.

Optical sensor 113

As illustrated in FIGS. 3 and 7, an optical sensor 113 is disposed on the top wall 83 of the holder 101. The optical sensor 113 includes a light emitting unit and a light receiving unit. The light emitting unit and the light receiving unit are disposed to face each other with a space in the left-right direction.

The optical sensor 113 outputs different detection signals to a controller 1 (see FIG. 3) depending on whether or not light irradiated from the light emitting unit along the left-right direction is received by the light receiving unit. For example, the optical sensor 113 outputs a low level signal to the controller 1 on condition that the light irradiated from the light emitting unit cannot be received by the light receiving unit (that is, a received light intensity is less than a predetermined intensity). On the other hand, the optical sensor 113 outputs a high level signal to the controller 1 on condition that light output from the light emitting unit can be received by the light receiving unit (that is, the received light intensity is equal to or higher than the predetermined intensity).

The controller 1 controls an operation of the multi function device 10 and is composed of, for example, a CPU, a ROM, a RAM, and the like. The CPU, the ROM, the RAM and the like are installed on a control board 3. As illustrated in FIG. 1, the control board 3 is disposed in the right rear part inside the lower casing 13. As illustrated in FIG. 4, a cable 4 that connects the optical sensor 113 of the mounting unit 110B and the control board 3 is wired rightward through a space in front of the recording head 21 above the conveyance path 24 from the mounting unit 110B toward the mounting unit 110A, and is wired rearward toward the control board 3 together with the cable 4 extending from the optical sensor 113 disposed corresponding to 103M and 103Y. The cable 4 connecting the optical sensor 113 of the mounting unit 110A and the control board 3 is wired rearward from the mounting unit 110A toward the control board 3. A disposition position of the control board 3 may be other than the right rear part inside the lower casing 13. The wiring of the cable 4 is appropriately determined according to the disposition position of the control board 3.

Connector 130

As illustrated in FIGS. 3 and 7, the connector 130 is disposed on the top wall 83 of the holder 101. The connector 130 includes four contacts 132. The four contacts 132 are disposed in parallel at intervals in the left-right direction. Each contact 132 corresponds to each of electrodes 65 of a circuit board 64 of the ink cartridge 30. The number of contacts 132 is not limited to four.

The contact 132 is made of a member having conductivity and elasticity. The contact 132 protrudes forward from the connector 130. The contact 132 is connected to a board (not illustrated). With this configuration, similarly, the contact 132 is electrically connected to an electric circuit installed on the board. The electric circuit is electrically connected to the controller 1 (see FIG. 3) by a cable 5. The cable 5 is wired in the same manner as the cable 4 (see FIG. 3).

In the illustrative aspect, only the connector 130 corresponding to the tank 103B, among the tanks 103B, 103C, 103M, and 103Y, is provided. That is, the connector 130 is provided corresponding to one room of the mounting unit 110B, and is not provided in the mounting unit 110A. However, the connector 130 may be provided corresponding to at least one of the tanks 103C, 103M, and 103Y. That is, the connector 130 may be provided in at least one of the three rooms of the mounting unit 110A.

Ink cartridge 30

Figure 6A:
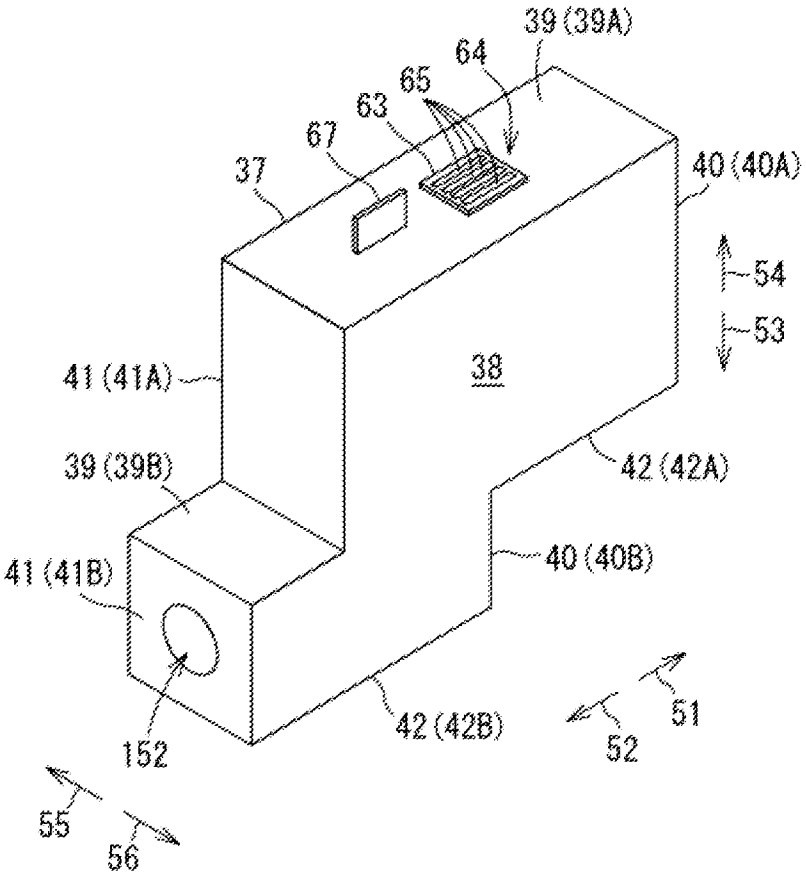
FIG. 6A is a perspective view of the ink cartridge 30.

The ink cartridge 30 illustrated in FIG. 6A is a container for storing ink. Three ink cartridges 30 are accommodated in the respective rooms of the internal space 108 (see FIG. 3) divided into three holders 101 of the mounting unit 110A. One ink cartridge 30 is accommodated in the internal space 108 (see FIG. 3) of the holder 101 of the mounting unit 110B.

As described above, the internal space 108 of the holder 101 of the mounting unit 110A is partitioned into three rooms aligned in the left-right direction. That is, as illustrated in FIG. 1, three ink cartridges 30 mounted in the internal space 108 of the holder 101 of the mounting unit 110A are disposed in parallel along the left-right direction. When a plurality of ink cartridges 30 are disposed in the mounting unit 110B, the plurality of ink cartridges 30 may also be disposed in parallel along the left-right direction.

The color of the ink stored in the ink cartridge 30 disposed in each room of the internal space 108 is the same color as the color of the ink stored in the tank 103 disposed in each room. That is, in the illustrative aspect, in the three rooms of the internal space 108 of the holder 101 of the mounting portion 110A, an ink cartridge 30 (hereinafter referred to as an ink cartridge 30C) in which cyan ink is stored, an ink cartridge 30 (hereinafter referred to as an ink cartridge 30M) in which magenta ink is stored, and an ink cartridge 30 (hereinafter referred to as an ink cartridge 30Y) in which yellow ink is stored are mounted in order from the left room. In one room of the internal space 108 of the holder 101 of the mounting unit 110B, an ink cartridge 30 (hereinafter referred to as an ink cartridge 30B) in which black ink is stored is mounted. That is, the ink cartridge 30C is connected to the tank 103C, the ink cartridge 30M is connected to the tank 103M, the ink cartridge 30Y is connected to the tank 103Y, and the ink cartridge 30B is connected to the tank 103B. Hereinafter, the ink cartridges 30C, 30M, 30Y, and 30B are collectively referred to as the ink cartridge 30. The ink cartridge 30B is an example of a first reservoir. The ink cartridges 30C, 30M, and 30Y are examples of a second reservoir.

The number of ink cartridges 30 disposed in the internal space 108 and the color and material of ink stored in the ink cartridge 30 disposed in each room are determined according to the configuration (the number of rooms in the internal space 108 of the holder 101 of the mounting unit 110, the color and material of the ink stored in each tank 103) of the mounting unit 110.

The ink cartridges 30C, 30M, 30Y, and 30B have substantially the same configuration except that the ink cartridge 30B is larger than the ink cartridges 30C, 30M, and 30Y. For that reason, the configuration of the ink cartridge 30B will be described below, and the configuration of the ink cartridges 30C, 30M, and 30Y will be omitted in principle and will be described as necessary. In the following, although the configuration of the ink cartridge 30B will be described, for convenience, the ink cartridge 30B will be referred to as the ink cartridge 30.

As illustrated in FIGS. 6A and 7, the ink cartridge 30 includes the casing 31, a protrusion 67, and a circuit board 64. In the following description of the configuration of the ink cartridge 30, unless otherwise specified, the front-rear direction, the up-down direction, and the left-right direction are defined on the assumption that the ink cartridge 30 is in the standing posture (the posture connected to the tank 103 and the posture illustrated in FIGS. 7 and 8).

As illustrated in FIG. 6A, the casing 31 as a whole has a dimension along the left-right direction smaller than a dimension along the front-rear direction, and has a flat shape in which the dimensions along the up-down direction and the front-rear direction are larger than the dimension along the left-right direction.

The casing 31 includes a front wall 40, a rear wall 41, an upper wall 39, a lower wall 42, a right side wall 37, and a left side wall 38. The front wall 40 includes an upper front wall 40A and a lower front wall 40B. The rear wall 41 includes an upper rear wall 41A and a lower rear wall 41B. The upper wall 39 includes a front upper wall 39A and a rear upper wall 39B. The lower wall 42 includes a front lower wall 42A and a rear lower wall 42B.

The upper front wall 40A and the upper rear wall 41A face each other in the front-rear direction. The front upper wall 39A connects the upper end of the upper front wall 40A and the upper end of the upper rear wall 41A. The front lower wall 42A extends rearward from the lower end of the upper front wall 40A. The rear end of the front lower wall 42A is in front of the rear end of the front upper wall 39A. The lower front wall 40B extends downward from the rear end of the front lower wall 42A. The rear upper wall 39B extends rearward from the lower end of the upper rear wall 41A. The lower rear wall 41B extends downward from the rear end of the rear upper wall 39B. The lower rear wall 41B and the lower front wall 40B face each other in the front-rear direction. The rear lower wall 42B connects the lower end of the lower front wall 40B and the lower end of the lower rear wall 41B.

The right side wall 37 is continuous with the right end of each of the front wall 40, the rear wall 41, the upper wall 39, and the lower wall 42. The left side wall 38 is continuous with the left end of each of the front wall 40, the rear wall 41, the upper wall 39, and the lower wall 42. The right side wall 37 and the left side wall 38 face each other in the left-right direction.

As illustrated in FIG. 7, the casing 31 includes an internal space 151. The internal space 151 is a space constituted with the front wall 40, the rear wall 41, the upper wall 39, the lower wall 42, the right side wall 37, and the left side wall 38. In the internal space 151, ink can be stored.

The internal space 151 is constituted with a first space 161 and a second space 162. The first space 161 is a space constituted with the upper front wall 40A, the upper rear wall 41A, the front upper wall 39A, the front lower wall 42A, the right side wall 37, and the left side wall 38. The second space 162 is a space constituted with the lower front wall 40B, the lower rear wall 41B, the rear upper wall 39B, the rear lower wall 42B, the right side wall 37, and the left side wall 38. The rear part of the lower end of the first space 161 communicates with the front part of the upper end of the second space 162 by a gap 163 formed between the rear end of the front lower wall 42A and the front end of the rear upper wall 39B in the front-rear direction. In other words, a space in which a coil spring 36 is accommodated communicates with a space for storing ink in the up-down direction.

As illustrated in FIG. 7 and FIG. 8, the casing 31 is inserted and mounted rearwardly with respect to the holder 101 and is extracted toward the front (see FIG. 7), through the opening 112 (see FIG. 8).

The casing 31 has translucency that allows ink stored in the internal space 151 to be visually recognized from the outside.

As illustrated in FIG. 1, in the mounted state, the front wall 40 of the casing 31 is directed forward. With this configuration, when the casing 13 is viewed from the front, the front wall 40 is visible through the opening 112. Since the front wall 40 has translucency, the ink stored in the internal space 151 is visible through the opening 112 and the front wall 40 when the casing 13 is viewed from the front. In the illustrative aspect, the ink stored in the ink cartridges 30C, 30M, and 30Y is visible through the opening 112 and the front wall 40 formed in the right end part of the front wall 44, and the ink stored in the ink cartridge 30B is visible through the opening 112 and the front wall 40 formed in the left end part of the front wall 44.

In the casing 31 of the ink cartridge 30 to be mounted on the mounting portion 110, it is sufficient that at least the front wall 40 directed forward has translucency.

As illustrated in FIG. 6A, a through-hole 152 (an example of a liquid flowing hole) is formed in the lower rear wall 41B of the casing 31. The second space 162 of the internal space 151 communicates with the outside through the through-hole 152. The ink stored in the internal space 151 can flow outside through the through-hole 152.

In the second space 162, a valve 35 and the coil spring 36 are disposed. The valve 35 is movable between an open position illustrated in FIG. 8 and a closed position illustrated in FIG. 8. The valve 35 in the open position is in contact with the lower rear wall 41B. With this configuration, the through-hole 152 is closed. The valve 35 in the closed position is separated from the lower rear wall 41B. With this configuration, the through-hole 152 is opened. One end of the coil spring 36 is connected to the valve 35. The other end of the coil spring 36 is connected to the lower front wall 40B. The coil spring 36 urges the valve 35 toward the lower rear wall 41B, that is, the valve 35 toward the closed position.

A unit for closing the through-hole 152 is not limited to the valve 35 and the coil spring 36. For example, a so-called duckbill type valve may be attached to the through-hole 152, and a seal may be attached to the through-hole 152.

Protrusion 67

As illustrated in FIGS. 6A and 7, the front upper wall 39A of the casing 31 includes a protrusion 67 protruding upward. The protrusion 67 extends in the front-rear direction.

The right surface or the left surface of the protrusion 67 is a surface that light irradiated by the optical sensor 113 of the mounting unit 110 strikes. In the illustrative aspect, the protrusion 67 is a resin plate containing a color material (black pigment) that can block or attenuate light, for example. As another form, a material that cannot transmit light, such as an aluminum foil, may be attached to at least a light blocking surface of the protrusion 67.

Circuit board 64

As illustrated in FIG. 6A, the circuit board 64 is attached to the front upper wall 39A of the casing 31. The circuit board 64 is in front of the protrusion 67. The circuit board 64 includes a board 63, a memory (not illustrated), and electrodes 65.

In the illustrative aspect, the circuit board 64 is provided only in the ink cartridge 30B among the ink cartridges 30B, 30C, 30M, and 30Y. That is, the circuit board 64 is not provided in the ink cartridges 30C, 30M, and 30Y. However, the circuit board 64 may be provided in at least one of the ink cartridges 30C, 30M, and 30Y.

In the circuit board 64, the memory is mounted on the board 63, which is a rigid board made of glass epoxy or the like and four electrodes 65 are formed on the board 63. The number of electrodes 65 is determined according to the number of contacts 132 of the mounting unit 110, and is not limited to four.

The memory is installed on the back surface (surface facing the front upper wall 39A) of the substrate 63. In the illustrative aspect, when the substrate 63 is attached to the front upper wall 39A, a recess (not illustrated) that can accommodate the memory is formed at a position corresponding to the memory on the front upper wall 39A. The installation position of the memory is not limited to the back surface of the substrate 63.

Information about the ink cartridge 30 is stored in the memory as to be readable by the controller 1 (see FIG. 3) of the multi function device 10. The information about the ink cartridge 30 is data indicating information such as a lot number, manufacturing date, ink color, and the like. Information about the amount of ink stored in the ink cartridge 30, such as the amount of ink consumed, may be stored. The memory is a semiconductor memory such as a nonvolatile memory such as FRAM (registered trademark) or a volatile memory such as SRAM.

Each of the four electrodes 65 corresponds to each of the four contacts 132 of the mounting unit 110. As illustrated in FIG. 6A, four electrodes 65 are exposed to be electrically connectable. Each electrode 65 extends along the front-rear direction. The electrodes 65 are aligned and spaced apart from each other in the left-right direction. Each electrode 65 is electrically connected to the memory.

Operation in which ink cartridge 30 is mounted to mounting unit 110

Hereinafter, an operation in which the ink cartridge 30 is mounted to the holder 101 of the mounting unit 110 will be described.

As illustrated in FIGS. 6A and 7, in the ink cartridge 30 that is not mounted to the mounting unit 110, the valve 35 urged by the coil spring 36 and is in a closed position. For that reason, the ink stored in the internal space 151 is prevented from flowing out to the outside.

In the mounting unit 110 to which the ink cartridge 30 is not mounted, there is no other member between the light emitting unit and the light receiving unit of the optical sensor 113. With this configuration, light can travel from the light emitting unit to the light receiving unit. Here, the optical sensor 113 outputs a high level detection signal to the controller 1 (see FIG. 3). When the controller 1 receives the high level detection signal from the optical sensor 113, the controller 1 determines that the ink cartridge 30 is not mounted to the mounting unit 110.

The ink cartridge 30 is inserted from the front of the holder 101 into the internal space 108 of the holder 101 through the opening 112 along the front-rear direction.

As illustrated in FIG. 8, when the ink cartridge 30 is inserted into the holder 101, the flow conduit 120 penetrates the through-hole 152 from the rear of the ink cartridge 30 along the front-rear direction and enters the second space 162 of the ink cartridge 30. That is, the flow conduit 120 is connected to the through-hole 152. The flow conduit 120 that has entered the second space 162 pushes the valve 35 forward. With this configuration, the valve 35 moves from the closed position to the open position against the urging force of the coil spring 36. As a result, the ink stored in the internal space 151 can flow to the internal space 119 of the tank 103 via the flow conduit 120. Since the opening 125B and the gap 163 are aligned in the up-down direction, air escapes through the gap 163 to the first space 161 side. Air is prevented from staying around the flow conduit 120 and hindering the supply of ink.

A ring member (not illustrated) made of an elastic body such as rubber is attached to a peripheral edge of the through-hole 152. The ring member is in liquid-tightly close contact with the outer peripheral surface of the flow conduit 120 penetrating the through-hole 152.

When the ink cartridge 30 is inserted into the holder 101, the protrusion 67 is positioned between the light emitting unit and the light receiving unit of the optical sensor 113. With this configuration, the protrusion 67 blocks light from traveling from the light emitting unit to the light receiving unit. Here, the optical sensor 113 outputs a low level detection signal to the controller 1 (see FIG. 3). When the controller 1 receives the low level detection signal from the optical sensor 113, the controller 1 determines that the ink cartridge 30 is mounted to the mounting unit 110.

When the ink cartridge 30 is inserted into the holder 101, each electrode 65 of the circuit board 64 comes into contact with each corresponding contact 132 from the front. As each electrode 65 comes into contact with the corresponding contact 132 and becomes conductive, a voltage Vc is applied to the electrode 65, the electrode 65 is grounded, or power is supplied to the electrode 65. Due to the conduction between the contact 132 and the electrode 65, the memory installed on the circuit board 64 is conducted with the controller 1 (see FIG. 3). With this configuration, the controller 1 can access the memory. As a result, data stored in the memory is input to the controller 1.

When the ink cartridge 30 is extracted from the holder 101, the user grasps the ink cartridge 30 and pulls the ink cartridge 30 forward. With this configuration, the flow conduit 120 is removed from the through-hole 152, and the ink cartridge 30 is extracted from the holder 101.

Hereinafter, the supply of ink from the ink cartridge 30 to the tank 103 in the mounted state illustrated in FIG. 8 will be described. In the illustrative aspect, the ink supply from the ink cartridge 30 to the tank 103 is performed by a so-called chicken feed method as will be described in detail below.

When the ink cartridge 30 is connected to the tank 103 and the openings 125B and 126B of the flow conduit 120 are positioned in the second space 162 of the ink cartridge 30, the internal space 151 and the internal space 119 of the tank 103 communicate with each other through the first flow path 125 and the second flow path 126. With this configuration, as indicated by the one-dot chain line arrow in FIG. 8, the ink stored in the internal space 151 flows to the second flow path 126 through the opening 126B, and flows from the opening 126A of the second flow path 126 to the internal space 119. During the flow of ink, as indicated by the broken arrow in FIG. 8, air enters the internal space 119 from the atmosphere communication hole 124 and flows into the internal space 151 from the first flow path 125 through the opening 125B. Here, the volume of ink flowing from the ink cartridge 30 to the tank 103 and the volume of air flowing from the tank 103 to the ink cartridge 30 are substantially the same. Therefore, so-called gas-to-liquid substitution is performed.

When the ink flows into the internal space 119 and the liquid level of the ink in the internal space 119 rises and reaches the opening 125A of the first flow path 125, the flow of air between the flow path 125 and the internal space 151 is blocked. With this configuration, the flow of air from the internal space 119 to the internal space 151 is stopped. For that reason, the flow of ink from the internal space 151 to the internal space 119 is stopped.

Operational effects of the embodiment

According to the illustrative aspect, the tank 103 is disposed separately on the right side and the left side of the conveyance path 24. With this configuration, the size of each tank 103 can be enlarged as compared with the configuration in which all of the tanks 103 are disposed only on one side of the conveyance paths 24 in the left-right direction.

According to the illustrative aspect, for example, a mechanism that is necessary only for ink having the first specific gravity (for example, a pigment stirring mechanism that is necessary when the ink having the first specific gravity is pigment) may be disposed only near the tank 103B. That is, the mechanism does not need to be disposed near the tanks 103C, 103M, and 103Y. For that reason, the tanks 103C, 103M, and 103Y can be enlarged.

According to the illustrative aspect, when the ink stored in the tank 103 is consumed and the liquid level of the ink becomes lower than the opening 125A at the lower end of the first flow path 125 in the mounted state, air enters the tank 103 from the atmosphere communication hole 124 and enters the ink cartridge 30 through the first flow path 125. Then, ink corresponding to the volume of the air that has entered the ink cartridge 30 is supplied from the ink cartridge 30 into the tank 103 through the second flow path 126. When the liquid level of the ink in the tank 103 reaches the opening 125A of the first flow path 125, the supply of ink is stopped. With this configuration, the liquid level of the ink stored in the tank 103 can be kept constant.

MODIFICATION EXAMPLE

In the illustrative aspect described above, the ink cartridge 30 is inserted into the mounting unit 110 along the front-rear direction, and the flow conduit 120 is connected to the through-hole 152 along the front-rear direction. However, the direction of the insertion and the direction of the connection may be any direction that intersects the up-down direction and the left-right direction, and is not limited to the front-rear direction. For example, the direction of the insertion and the direction of the connection may be inclined with respect to the front-rear direction.

In the illustrative aspect described above, although the ink cartridge 30 including the circuit board 64 and the protrusion 67 is connected to the tank 103, the reservoir connected to the tank 103 is not limited to the ink cartridge 30. For example, a bottle 170 that does not include the circuit board 64 and the protrusion 67 may be connected to the tank 103 as a reservoir.

Figure 9:
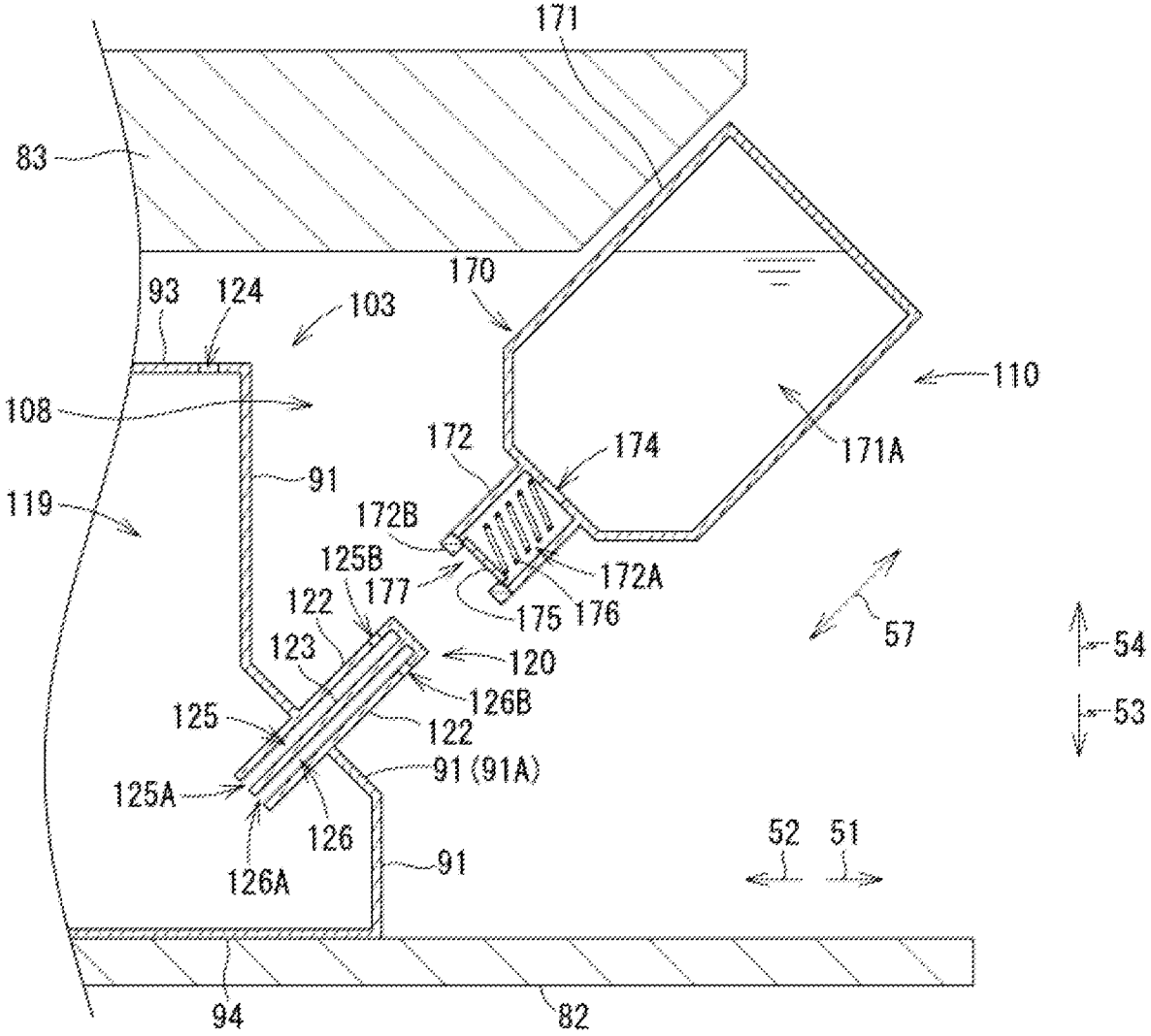
FIG. 9 is a longitudinal sectional view of the ink cartridge 30 in a state of not being mounted and a periphery thereof in a modification example.
Figure 10:
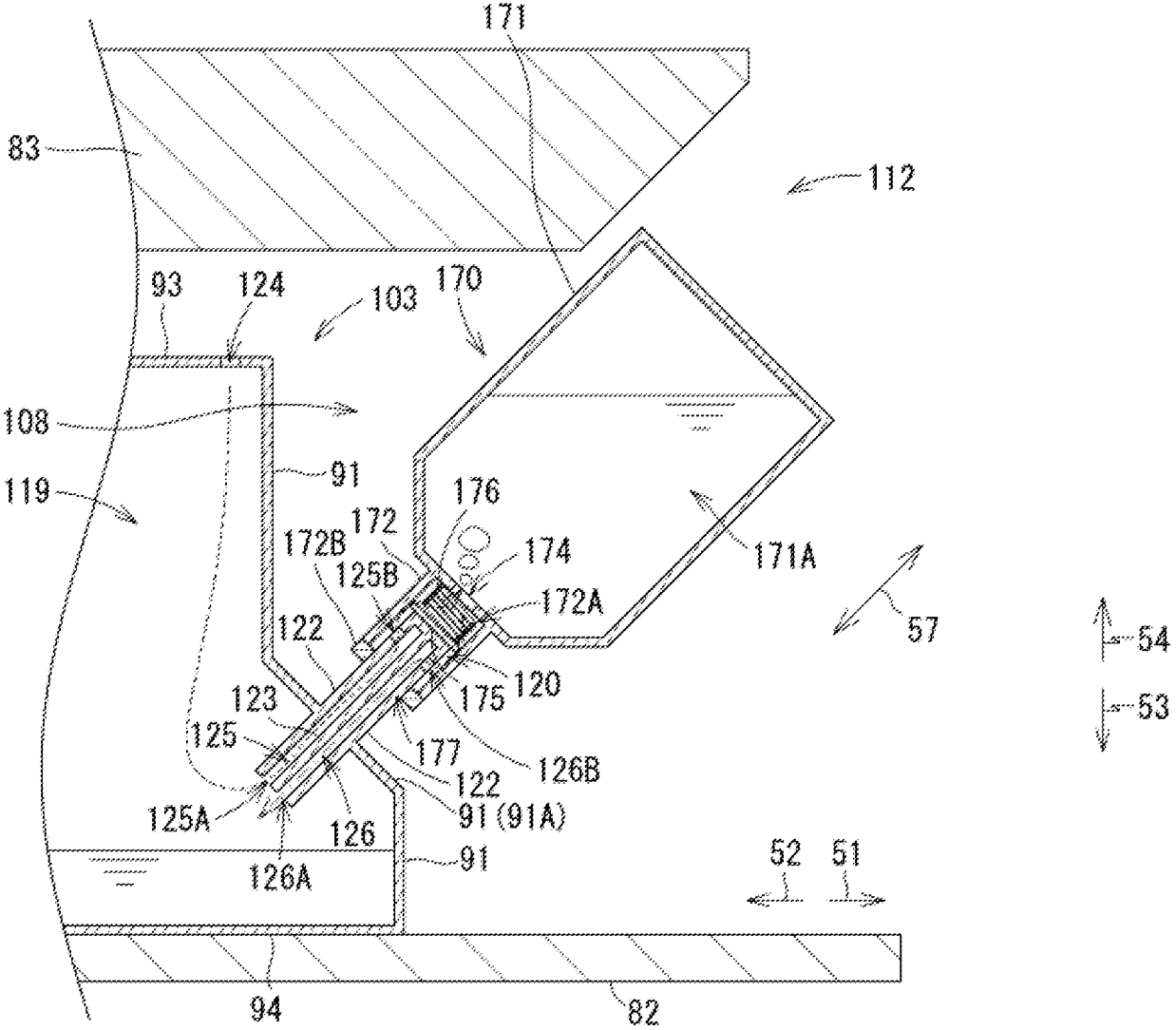
FIG. 10 is a longitudinal sectional view of the periphery of the ink cartridge 30 in a mounted state in the modification example.

For example, in FIGS. 9 and 10, a configuration in which the bottle 170 is connected to the tank 103 obliquely forward from above the tank 103 along an inclined direction 57 inclined with respect to the front-rear direction is illustrated. Here, the front wall 91 of the tank 103 includes an inclined wall 91A that is directed forward as it goes downward. The flow conduit 120 extends in the inclined direction 57 and penetrates the inclined wall 91A.

The bottle 170 includes a substantially cylindrical main body 171 and a protruding portion 172 protruding from the main body 171. An internal space 171A of the main body 171 and an internal space 172A of the protruding portion 172 communicate with each other through a through-hole 174 formed on an inner wall 173. A through-hole 177 is formed on a tip end wall 172B of the protruding portion 172.

A valve 175 and a coil spring 176 are disposed in the internal space 172A. The valve 175 is movable between an open position illustrated in FIG. 9 and a closed position illustrated in FIG. 10. The valve 175 in the open position is in contact with the tip end wall 172B. With this configuration, the through-hole 177 is closed. The valve 175 in the closed position is separated from the tip end wall 172B. With this configuration, the through-hole 177 is opened. One end of the coil spring 36 is connected to the valve 175. The other end of the coil spring 36 is connected to the inner wall 173. The coil spring 176 urges the valve 175 toward the tip end wall 172B, that is, the valve 175 toward the closed position.

In the configuration illustrated in FIGS. 9 and 10, the operation of mounting the ink cartridge 30 to the mounting unit 110 is the same as that in the illustrative aspect described above except that the mounting direction of the ink cartridge 30 is the inclined direction 57 instead of the front-rear direction. That is, the valve 35 is moved from the closed position to the open position by being pushed by the flow conduit 120 that has entered the internal space 172A along the inclined direction 57, and ink stored in the internal spaces 171A and 172A can flow to the internal space 119 of the tank 103 via the flow conduit 120.

In the configuration illustrated in FIGS. 9 and 10, the bottle 170 is accommodated in the internal space 108 of the mounting unit 110 in the state of being mounted on the mounting unit 110, similarly as in the illustrative aspect described above. That is, the bottle 170 is used while being mounted to the mounting unit 110.

According to the modification example illustrated in FIGS. 9 and 10, the ink cartridge 30 is connected to the tank 103 obliquely from above. For that reason, the most part of the ink cartridge 30 are above the tank 103. With this configuration, it is easy to use up the ink stored in the ink cartridge 30.

According to the modification example illustrated in FIGS. 9 and 10, when the cylindrical bottle 170 is used while being mounted to the mounting unit 110, the mounting unit 110 is disposed separately on the left and right with the conveyance path 24 in between, thereby capable of securing a large accommodation space for the bottle 170.

In the illustrative aspect described above, in the internal space 108 of the holder 101, the tanks 103 are disposed in parallel along the left-right direction. However, the disposition of the tanks 103 is not limited to the parallel disposition along the left-right direction.

Figure 11A:
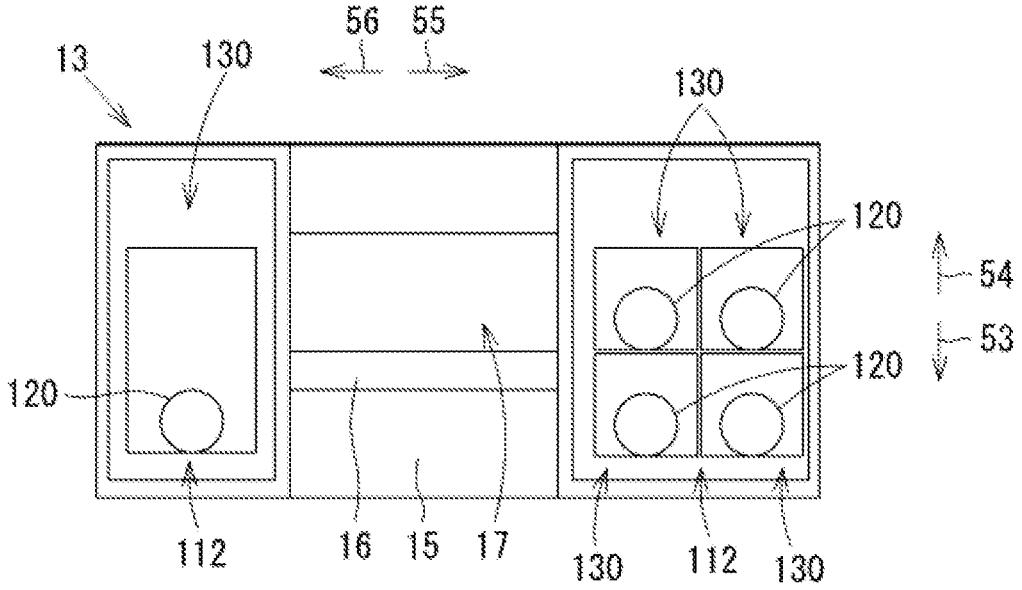
FIGS. 11A and 11B are front views of the casing 13 in the modification example.
Figure 11B:
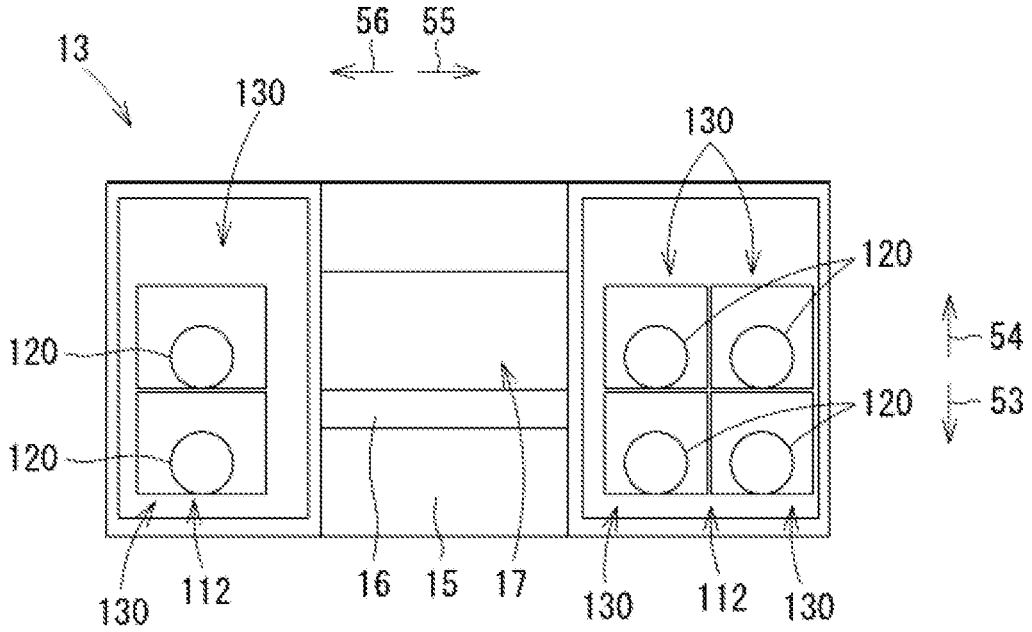

For example, as illustrated in FIG. 11A, in the internal space 108 of the holder 101 of the mounting unit 110A, the tanks 103 including the flow conduit 120 may be disposed side by side in the up-down direction. As illustrated in FIG. 11B, in the internal space 108 of the holders 101 of both the mounting units 110A and 110B, the tanks 103 including the flow conduit 120 may be disposed side by side in the up-down direction. Although not illustrated, in the internal space 108 of the holder 101 of the mounting unit 110B, the tanks 103 including the flow conduit 120 may be disposed side by side in the up-down direction. The ink cartridges 30 connected to these tanks 103 are also disposed side by side in the up-down direction.

The tank 103 may be disposed side by side in both the left-right direction and the up-down direction, like the tank 103 disposed in the mounting unit 110B illustrated in FIG. 11B, and may be disposed side by side only in the up-down direction, like the tank 103 disposed in the mounting portion 110A illustrated in FIGS. 11A and 11B.

Figure 12:
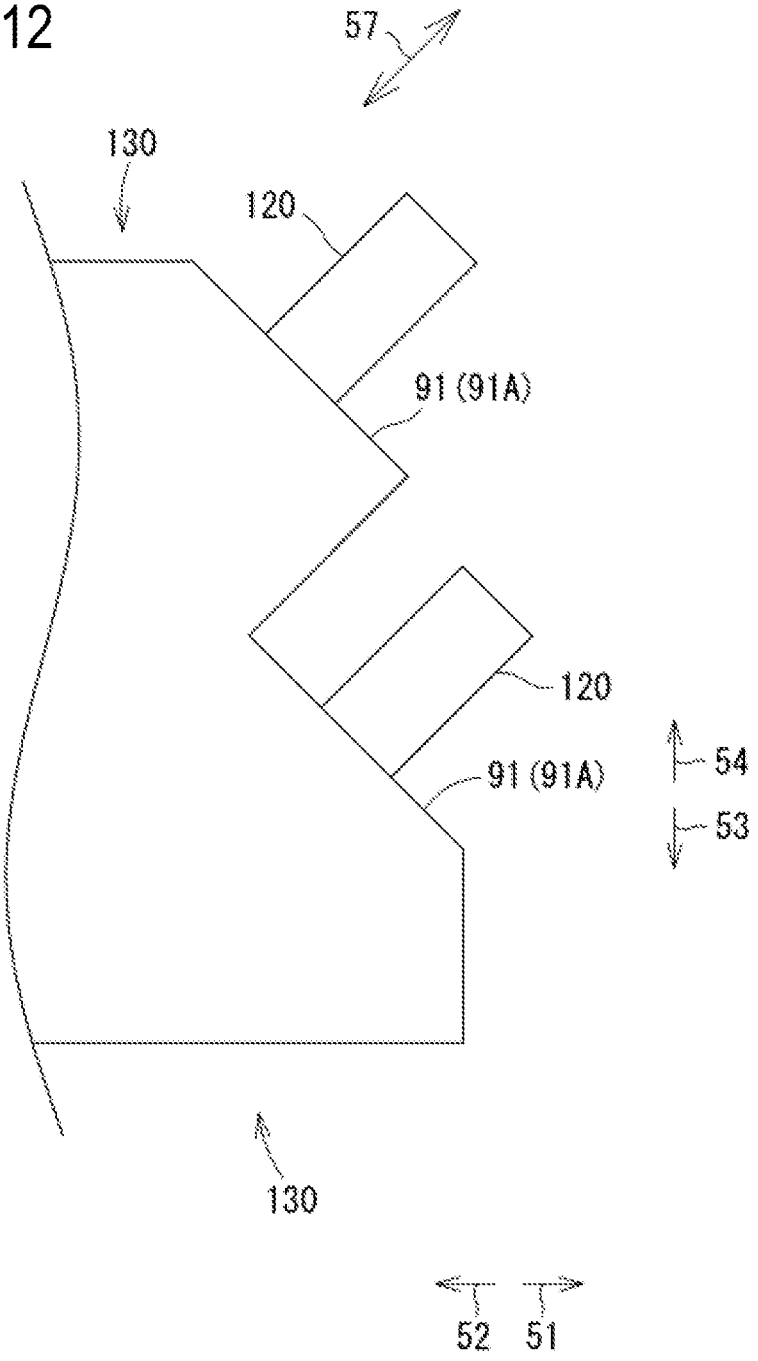
FIG. 12 is a left side view of a front part of the tank 103 in the modification example.

As illustrated in FIG. 12, also in the configuration in which the tanks 103 are disposed side by side in the up-down direction, the flow conduit 120 of each tank 103 may protrude in a direction inclined with respect to the front-rear direction (inclined direction 57 in FIG. 12).

According to the modification example illustrated in FIGS. 11A and 11B, each tank 103 can be lengthened in the left-right direction. With this configuration, the diameter of the flow conduit 120 can be increased. As a result, the flow of ink from the ink cartridge 30 to the tank 103 can be quickly performed.

In the illustrative aspect described above, the supply of ink from the ink cartridge 30 to the tank 103 is performed by the chicken feed method, but may be performed by a method other than the chicken feed method. For example, as described in detail below with reference to FIGS. 13 and 14, the supply of ink from the ink cartridge 30 to the tank 103 may be performed by a water head difference between the liquid level of the ink stored in the internal space 151 of the ink cartridge 30 and the liquid level of the ink stored in the internal space 119 of the tank 103. In the following description, a portion having a configuration different from that of the illustrative aspect described above will be described, and description of a portion having the same configuration as that of the illustrative aspect described above be omitted.

The flow conduit 120 does not include the partition wall 123. That is, the internal space of the flow conduit 120 is formed by only one flow path 127. An opening 127A is formed at one end (rear end) of the flow conduit 120. An opening 127B is formed at the other end (front end) of the flow conduit 120.

An atmosphere communication hole that penetrates the front upper wall 39A is formed on the front upper wall 39A of the ink cartridge 30. With this configuration, the internal space 151 communicates with the atmosphere. A seal 156 is attached to the atmosphere communication hole 155. The seal 156 is peeled off before the ink cartridge 30 is connected to the tank 103. A unit for opening the atmosphere communication hole 155 is not limited to the one using the seal 156 described above, and a known unit such as a unit for opening and closing the atmosphere communication hole 155 by a valve can be employed.

The ink cartridge 30 is mounted to the holder 101 of the mounting unit 110 in the same manner as in the illustrative aspect described above.

Figure 13:
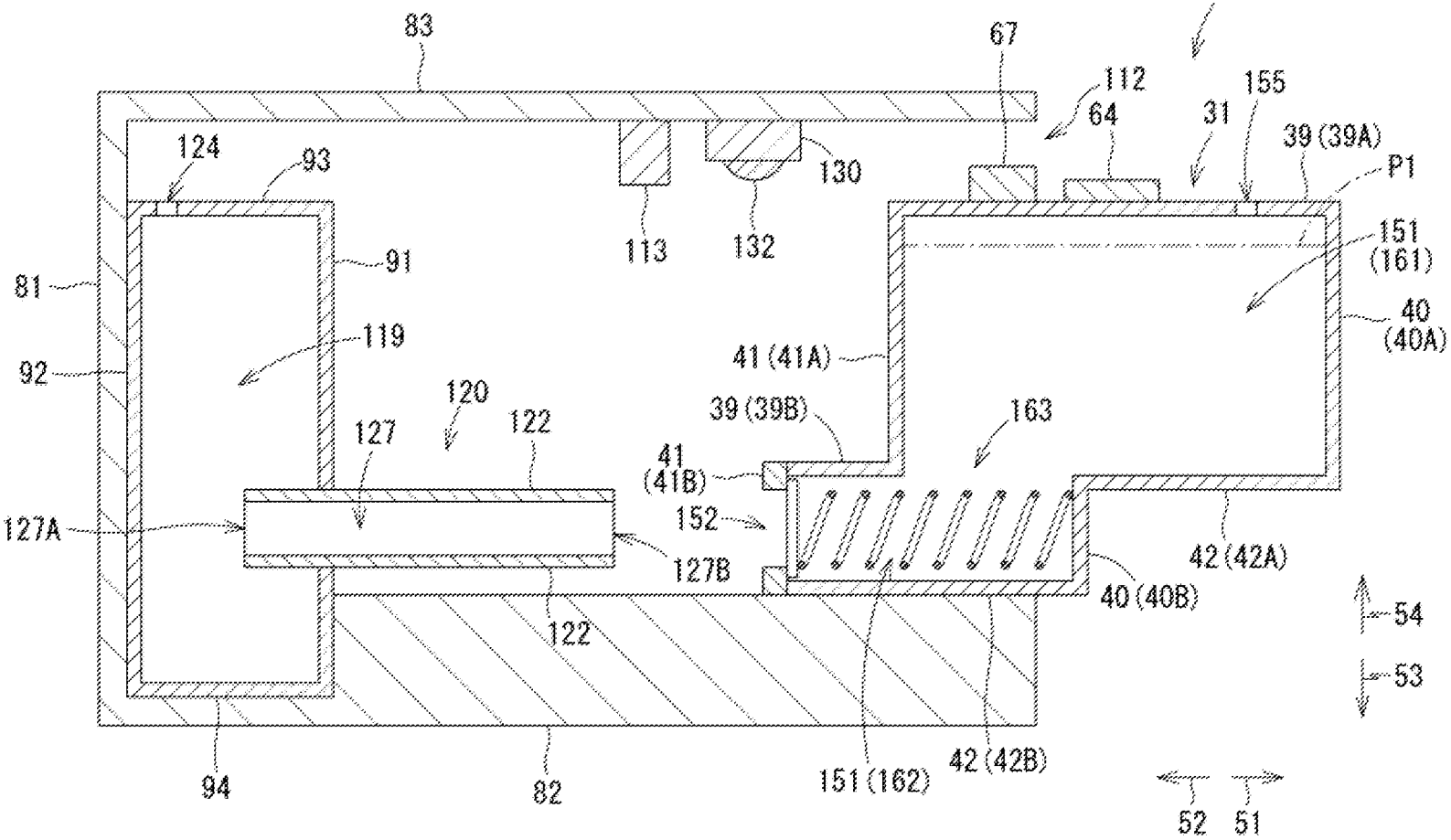
FIG. 13 is another longitudinal sectional view of the ink cartridge 30 in the state of not being mounted and the periphery thereof in the modification example.

As illustrated in FIG. 13, before the ink cartridge 30 is connected to the tank 103, the liquid level of the ink stored in the internal space 151 is a position P1.

Figure 14:
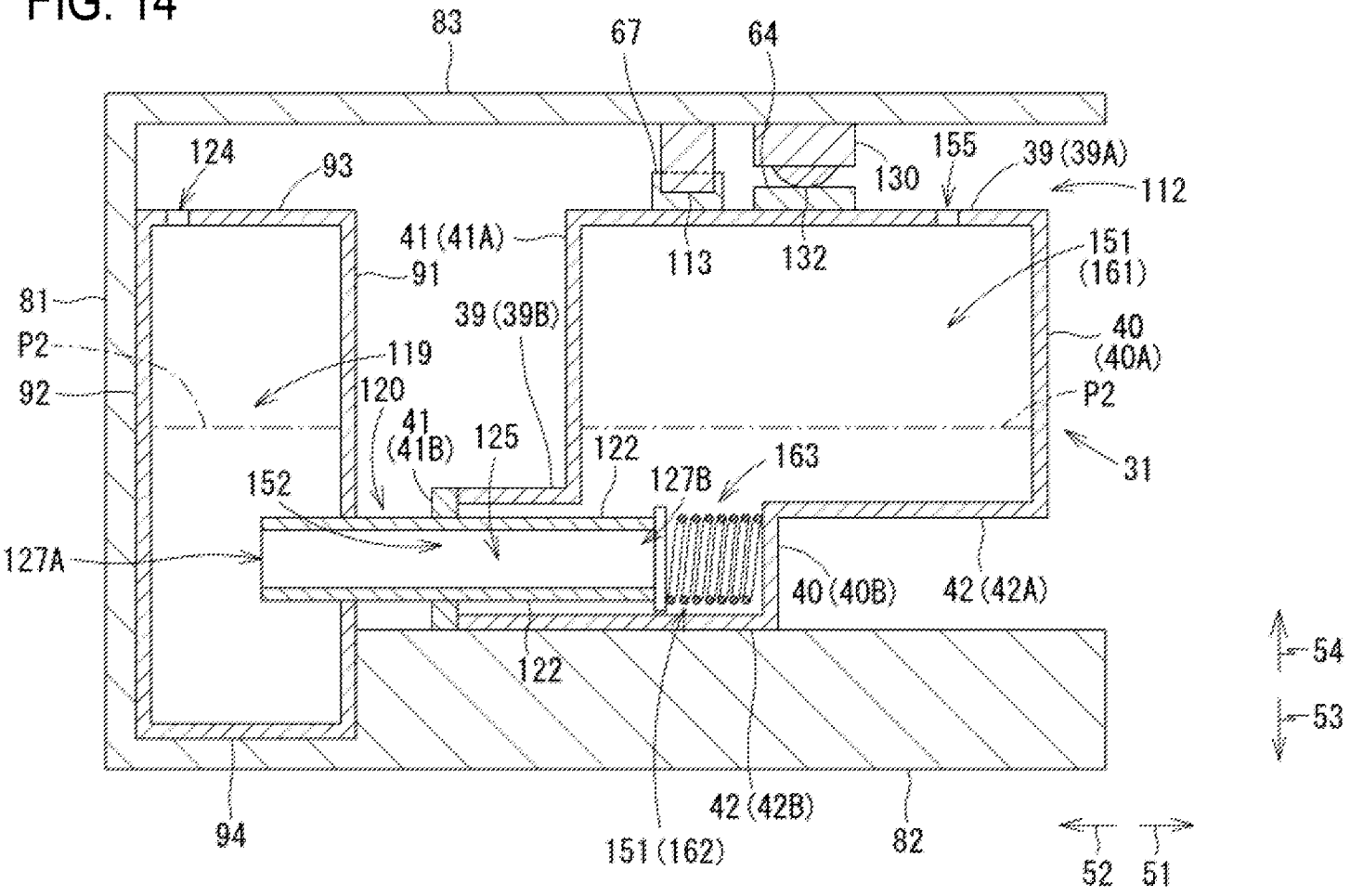
FIG. 14 is another longitudinal sectional view of the periphery of the ink cartridge 30 in the mounted state in the modification example.

As illustrated in FIG. 14, when the ink cartridge 30 is connected to the tank 103, ink flows from the internal space 151 to the internal space 119 via the flow path 127 due to the water head difference between the liquid levels in the internal spaces 151 and 119. As a result, the liquid level of the ink stored in the internal spaces 151 and 119 becomes a position P2.

According to the modification example illustrated in FIGS. 13 and 14, the ink stored in the ink cartridge 30 can be supplied to the tank 103 without requiring a complicated configuration.

The shapes of the ink cartridge 30 and the tank 103 are not limited to the shapes described above, and can take various shapes.

In the illustrative aspect described above, although ink has been described as an example of a liquid, for example, a pretreatment liquid that is ejected onto a sheet or the like prior to ink during printing may be stored in a liquid cartridge instead of ink. Water for cleaning the recording head 21 may be stored in the liquid cartridge.

According to the configuration (1), the first tank and the second tank (hereinafter, the first tank and the second tank are collectively referred to as a tank) are disposed separately on one side and the other side of the conveyance path in the width direction. With this configuration, the size of each tank can be enlarged as compared with a configuration in which all the tanks are disposed only on one side of the conveyance path in the width direction.

(2) For example, the first direction is the depth direction.

(3) The first direction is a direction inclined upward with respect to the depth direction.

According to the configurations (2) and (3), the first reservoir and the second reservoir (hereinafter, the first reservoir and the second reservoir are collectively referred to as a reservoir) are connected to the tank obliquely from above. For that reason, the most part of the reservoir are above the tank. With this configuration, it is easy to use up the liquid stored in the reservoir.

(4) For example, the system includes a plurality of at least one of the first tank and the second tank, and at least one of the plurality of first tanks and the plurality of second tanks is disposed in parallel along the width direction.

(5) The system includes a plurality of at least one of the first tank and the second tank, and in at least one of the plurality of first tanks and the plurality of second tanks, at least one of the first flow conduit or the second flow conduit is disposed side by side in the height direction.

According to the configurations (4) and (5), each tank can be lengthened in the width direction. With this configuration, the diameters of the first flow conduit and the second flow conduit can be increased. As a result, the flow of liquid from the reservoir to the tank can be quickly performed.

(6) In the first reservoir, liquid having a first specific gravity is stored, and in and the second reservoir, liquid having a second specific gravity smaller than the first specific gravity is stored.

According to the configuration (6), for example, a mechanism (for example, a pigment stirring mechanism necessary when the liquid having the first specific gravity is pigment) necessary only for the liquid having the first specific gravity may be disposed only near the first tank. That is, it is not necessary to dispose the mechanism near the second tank. Therefore, the second tank can be enlarged.

(7) The first tank and the second tank include an atmosphere communication hole that allows an internal space of the first tank and the second tank to communicate with the atmosphere, a first flow path of which one end is below the atmosphere communication hole in the internal space and the other end is opened to the outside through the first flow conduit or the second flow conduit, and a second flow path of which one end is below the one end of the first flow path in the internal space and the other end is opened to the outside through the first flow conduit or the second flow conduit.

According to the configuration (7), in a state where the reservoir is connected to the tank, when the liquid stored in the tank is consumed and a liquid level of the liquid becomes lower than the opening at the lower end of the first flow path, air enters the tank through the atmosphere communication hole and enters the reservoir through the first flow path. Then, liquid corresponding to a volume of air that has entered the reservoir is supplied from the reservoir into the tank through the second flow path. When the liquid level of the liquid in the tank reaches the opening of the first flow path, the supply of liquid is stopped. With this configuration, the liquid level of the liquid stored in the tank can be kept constant.

(8) The first tank, the second tank, the first reservoir, and the second reservoir include an atmosphere communication hole that allows the inside of the first tank, the second tank, the first reservoir, and the second reservoir to communicate with the atmosphere, when the first reservoir is connected to the first tank, due to a water head difference between a liquid level of the liquid stored in the first reservoir and a liquid level of the liquid stored in the first tank, the liquid flows between the first reservoir and the first tank, and when the second reservoir is connected to the second tank, due to a water head difference between a liquid level of the liquid stored in the second reservoir and a liquid level of the liquid stored in the second tank, the liquid flows between the second reservoir and the second tank.

According to the configuration (8), the liquid stored in the reservoir can be supplied to the tank without requiring a complicated configuration.

According to the present invention, the tank can be enlarged.

What is claimed is:

1. A system comprising:

a casing that has a conveyance path that extends in a depth direction of the casing intersecting a height direction of the casing and through which a sheet passes;

a first tank that is disposed on one side of the conveyance path and in the casing in a width direction of the casing orthogonal to the height direction and the depth direction and is configured to store liquid in the first tank;

a second tank that is disposed on the other side of the conveyance path and in the casing in the width direction and is configured to store liquid in the second tank;

a first reservoir 30 that is connectable to the first tank 103 and is configured to store liquid in the first reservoir;

a second reservoir that is connectable to the second tank and is configured to store liquid in the second reservoir; and a liquid ejection head that is disposed inside the casing and is configured to eject liquid supplied from the first tank and the second tank, wherein the first tank and the second tank each include a first flow path and a second flow path;

the first reservoir includes a first liquid flowing, the second reservoir includes a second liquid flowing hole, the first tank includes a first flow conduit connectable to the first liquid flowing hole along a first direction intersecting the height direction and the width direction, and the second tank includes a second flow conduit connectable to the second liquid flowing hole along the first direction.

2. The system according to claim 1, wherein the first direction is the depth direction.

3. The system according to claim 1, wherein the first direction is a direction inclined upward with respect to the depth direction.

4. The system according to claim 1, wherein the system includes a plurality of at least one of the first tank and the second tank, and at least one of the plurality of first tanks and the plurality of second tanks is disposed in parallel along the width direction.

5. The system according to claim 1, wherein the system includes a plurality of at least one of the first tank and the second tank, and in at least one of the plurality of first tanks and the plurality of second tanks, at least one of the first flow conduit or the second flow conduit is disposed side by side in the height direction.

6. The system according to claim 1, wherein in the first reservoir, liquid having a first specific gravity is stored, and in the second reservoir, liquid having a second specific gravity smaller than the first specific gravity is stored.

7. The system according to claim 1, wherein the first tank and the second tank include an atmosphere communication hole that allows an internal space of the first tank and the second tank to communicate with the atmosphere, wherein the first flow path has one end below the atmosphere communication hole in the internal space and as second end opened to the outside through the first flow conduit or the second flow conduit, and wherein the second flow path has one end below the one end of the first flow path in the internal space and a second end opened to the outside through the first flow conduit or the second flow conduit.

8. The system according to claim 1, wherein the first tank, the second tank, the first reservoir, and the second reservoir include an atmosphere communication hole that allows the inside of the first tank, the second tank, the first reservoir, and the second reservoir to communicate with the atmosphere, when the first reservoir is connected to the first tank, due to a water head difference between a liquid level of the liquid stored in the first reservoir and a liquid level of the liquid stored in the first tank, the liquid flows between the first reservoir and the first tank, and when the second reservoir is connected to the second tank, due to a water head difference between a liquid level of the liquid stored in the second reservoir and a liquid level of the liquid stored in the second tank, the liquid flows between the second reservoir and the second tank.

9. The system according to claim 1, wherein the first reservoir includes a first bulb which is capable of opening and closing the first liquid flowing hole.

10. The system according to claim 9, wherein the second reservoir includes a second bulb which is capable of opening and closing the second liquid flowing hole.

* * * * *